US005503966A

United States Patent [19]

Adae-Amoakoh et al.

[11] Patent Number: 5,503,966

[45] Date of Patent: Apr. 2, 1996

[54] PHOTOGRAPHIC DEVELOPING COMPOSITIONS AND USE THEREOF IN THE PROCESSING OF PHOTOGRAPHIC ELEMENTS

[75] Inventors: Sylvia Adae-Amoakoh, Binghamton; Bruce M. Resnick, Vestal, both of N.Y.

[73] Assignee: International Paper Company, Purchase, N.Y.

[21] Appl. No.: 278,736

[22] Filed: Jul. 22, 1994

[51] Int. Cl.[6] ..... G03C 5/305

[52] U.S. Cl. ..... 430/492; 430/435; 430/440; 430/441; 430/480; 430/483; 430/486; 430/487; 430/489; 430/490; 430/491

[58] Field of Search ..... 430/435, 436, 430/440, 441, 445, 464, 465, 480, 483, 486, 487, 488, 489, 490, 491, 492

[56] References Cited

U.S. PATENT DOCUMENTS

| | | | |
|---|---|---|---|
| 2,688,549 | 9/1954 | James et al. | 430/480 |
| 3,022,168 | 2/1962 | St Jarnkvist | 430/478 |
| 3,826,654 | 7/1974 | Weiss et al. | 430/440 |
| 4,269,929 | 5/1981 | Nothnagle | 430/264 |

(List continued on next page.)

FOREIGN PATENT DOCUMENTS

0422677A1 4/1991 European Pat. Off. .

OTHER PUBLICATIONS

T. H. James, Chap. 17 Sensitometry of Black–White Materials, "Characteristic Curves", pp. 501–503.

Neblette, "The D LOG E Curve", *Photographic Sensitometry,* pp. 259–261.

"The Role of Antifoggants in Development" *The Journal of Photographic Science,* vol. 32, (1984) p. 128.

T. H. James, *Sensitometry of Black–White Materials,* "Antifoggants & Stabilizers", Ch 13, Mechanism of Development, pp. 396–397.

S. Moriuchi et al., "A New Technique for High Contrast Development in Rapid Processing", *The Journal of Photographic Science,* vol. 32, pp. 197–199.

H. C. Daly et al., "Graphic Art's Application of High–Contrast, Non–Lith Products", *The Journal of Photographic Science,* vol. 32, (1984), pp. 170–177.

D. Shiao et al., "Mathematical Modeling of Chemical Development", *Society of Photographic Scientists & Engineers,* vol. 25, No. 4, Jul./Aug., 1981, pp. 145–157.

"Research Disclosure–The Composition and Use of Photographic Materials in Graphic Pre Press Apllications", Jan. 1992, pp. 41–51.

Great Britain Patent Application 9410425.4 filed May 24, 1994 (Fryberg).

Great Britain Patent Application 9410400.7 filed May 24, 1994 (Fryberg).

Material Data Sheet for Kodak Dimezone S, Eastman Kodak Company, Rochester, New York (1990).

Material Data Sheet for IRGAFORM 1266 (Dimezone S) Ciba–Geigy Corporation, Three skyline Drive, Hawthorne, New York.

Material Data Sheet for METOL, Charkil Chemical Corporation, 1063 Post Road, Darien, Connecticut.

Material Data Sheet for METOL, Aldrich Chemical Co., Inc., Milwaukee, Wisconsin.

Material Data Sheet for GRAFKEM NON TOX RADR, GRAFKEN Corporation, 2445 W. 147th Street, Posen, Illinois Feb. 15, 1991.

*Primary Examiner*—Hoa Van Le

*Attorney, Agent, or Firm*—Ostrager, Chong & Flaherty

[57] ABSTRACT

Photographic developing compositions are provided that are free of dihydroxybenzene developing agents and are used in the processing of photographic elements. The developing compositions have a pH in the range of from 10.1 to 10.9 and comprise at least 0.17 moles per liter of an ascorbic acid developing agent, 0.3 to 0.5 moles per liter of a sulfite and 0.2 to 0.4 moles per liter of a carbonate buffer. Also provided is an ecologically advantageous method for processing photographic elements which utilizes the non-toxic developing compositions.

15 Claims, 15 Drawing Sheets

U.S. PATENT DOCUMENTS

| | | | |
|---|---|---|---|
| 4,634,660 | 1/1987 | Mifune et al. | 430/445 |
| 4,686,167 | 8/1987 | Resnick et al. | 430/264 |
| 4,816,384 | 3/1989 | Fruge et al. | 430/464 |
| 4,833,064 | 5/1989 | Okutsu et al. | 430/267 |
| 4,997,980 | 3/1991 | Resnick et al. | 564/27 |
| 5,098,819 | 3/1992 | Knapp | 430/436 |
| 5,108,880 | 4/1992 | Adkins | 430/487 |
| 5,196,298 | 3/1993 | Meeus et al. | 430/440 |
| 5,220,022 | 6/1993 | Resnick et al. | 544/160 |
| 5,236,816 | 8/1993 | Purol et al. | 430/492 |
| 5,264,323 | 11/1993 | Purol et al. | 430/264 |
| 5,278,035 | 1/1994 | Knapp | 430/452 |

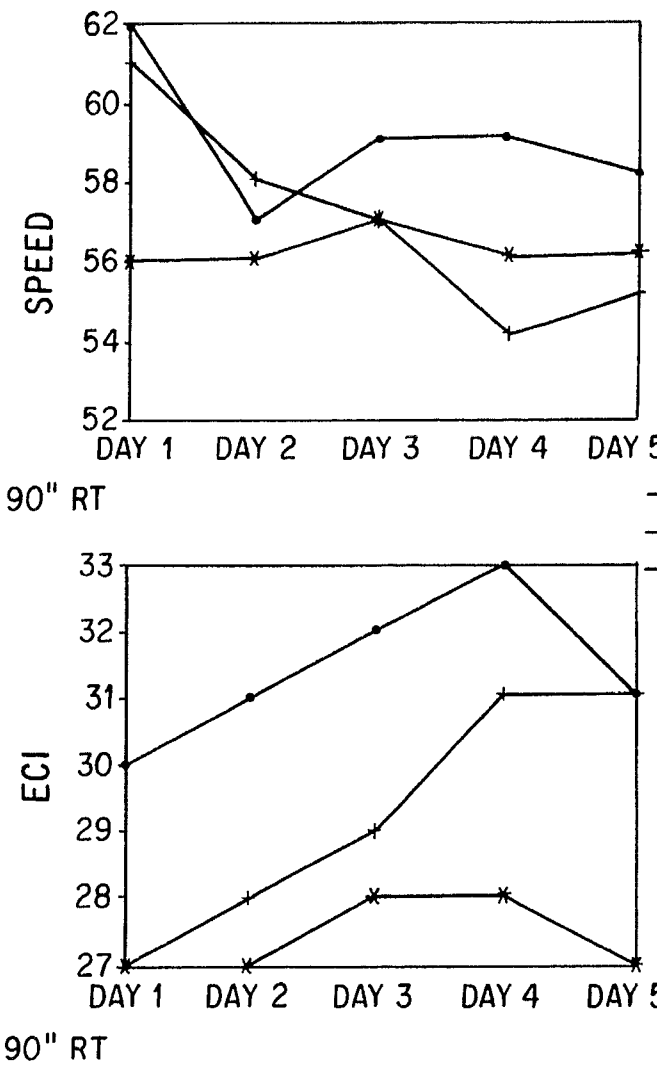
FIG. 10A
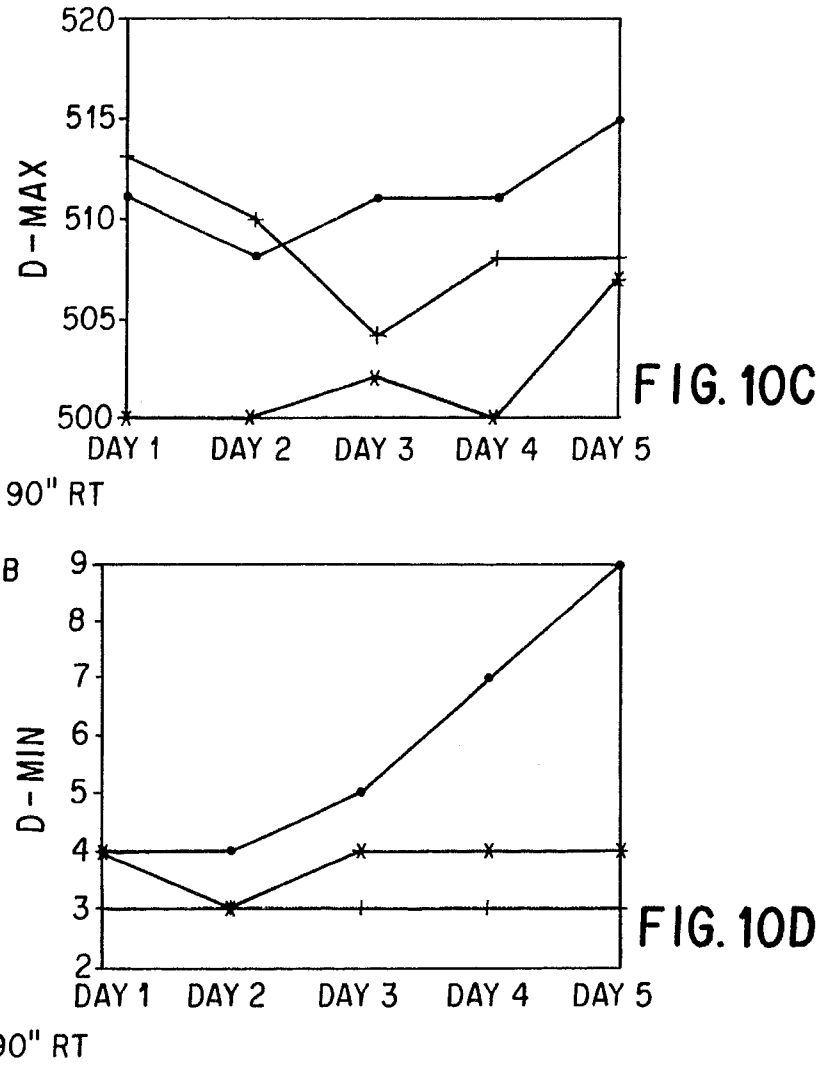
FIG. 10C
FIG. 10B
FIG. 10D

DF - 1
DF - 2
COMPOSITION B

—o—DEV. B
—+—PMT

SHLD. SPEED
865
860
855
850
845
840
835
25"
30"
35"
40"
45"
SECONDS
35c

SHLD. SPEED
885
875
865
855
845

GTM.
2,680
2,480
2,280
2,080
1,880
1,680
1,480
1,280

GTM
1,800
1,600
1,400
1,200
1,000
800
600

DEVELOPER COMPOSITION
B — 1
R — 2
O — 3
L — 4
E — 5
Q — 6

PHOTOGRAPHIC DEVELOPING COMPOSITIONS AND USE THEREOF IN THE PROCESSING OF PHOTOGRAPHIC ELEMENTS

FIELD OF INVENTION

This invention relates to photographic developing compositions that are free from dihydroxybenzene developing agents and their use in the processing of photographic elements. More particularly, it concerns photographic developing compositions including a non-toxic developing agent such as ascorbic acid which provides environmental advantages over hydroquinone developing agents. The non-toxic compositions are utilized in an ecologically safe method for processing photographic elements.

BACKGROUND ART

In graphic arts applications three developing systems are commonly used. Classical "lith" developers, conventional "rapid-access" developers and "hard-dot" rapid access systems which are also referred to as "hybrid" systems.

The mechanism for development of the three systems are distinct and account for their unique characteristics. The chart below illustrates the benefits and weaknesses of each development system.

| CHARACTERISTIC | LITH | RAP | HYBRID |
|---|---|---|---|
| RATE OF DEVELOPMENT | SLOW | FAST | FAST |
| STABILITY OF CHEMISTRY | PODR | GOOD | MEDIOCRE* |
| DOT QUALITY | EXCELLENT | POOR | EXCELLENT |
| DEVELOPMENT LATITUDE | POOR | GOOD | GOOD |
| COMPATIBLE EMULSIONS | HIGH CL- ONLY | ALL | ALL |
| SCREEN RANGE | POOR | WIDE | MEDIUM |
| AUXILIARY DEVELOPER | NO | YES | YES |

*Systems at lower pH are more stable

"Lith" developers are characterized by a low free sulfite content and the application of hydroquinone as the sole developing agent. This leads to development systems which produce sharp edged pictures on halftone and line copies.

The lith chemistry is referred to as an infectious developer (i.e. a cyclic mechanism that increases efficiency) but in reality it is not, and has the following mechanism:

(1) $HQ+AgX(EXPOSED)\rightarrow Q+Ag^{o}+HX$ (2) $Q+HQ\rightarrow 2SQ^{o}$ (3) $SQ^{o}+AgX(EXPOSED)\rightarrow Ag^{o}+Q+X^{-}$ The quinone (Q) from equation 3 recycles into equation 2. Inclusion of low amounts of free sulfite into the compositions as a preservative is optional. Typically lith films contain high chloride emulsions (at least about 60% by weight silver chloride based on total silver halide). The chemical stability of the lith chemistry is poor due to the low concentrations of sulfite and needs constant monitoring.

"Rapid access" developers are formulated by a combination of two superadditive developing agents and high sulfite content. This leads to their practical advantage of wide processing latitude, (i.e. development time and/or temperature) and excellent chemical stability of the developer solutions. These advantages however are at the expense of superior dot and line quality.

The Rapid Access Process (RAP) developer chemistry has the following mechanism:

(1) $HQ+AgX(EXPOSED)\rightarrow Q+Ag^{o}+HX$ (2) $Q+Phen^{-}\rightarrow HQ+Phen^{o}$ (3) $Q+SO_3^{=}\rightarrow HQSO_3^{-}$ The hydroquinone (HQ) reacts with the silver-halide when exposed to light to form elemental silver resulting in the formation of the latent image on the photographic element. The compositions include a relatively high sulfite content which reacts with the free quinone (Q) to form a sulfonated hydroquinone. The free quinone also reacts in the presence of the "auxiliary developer" i.e. phenidone ($Phen^{-}$) to regenerate hydroquinone. Other hydrazine compounds, including pyrazolidone compounds, and amino phenols can be used as "auxiliary developers" in RAP development systems.

The "hard-dot" rapid access or "hybrid" systems combine the good features of both rapid-access and lith developers into one formula. On the one hand lith-like halftone dot acutance has been obtained by means of an infectious developer. On the other hand rapid access is achieved by a system that maintains its stability and consistency by means of a single replenisher and can be run in simple, compact and inexpensive machines. This is achieved by combining a high sulfite content and an auxiliary developing agent. Possible mechanisms for this hybrid system can be based on, but are not restricted to hydrazine or tetrazolium salt chemistries which are also referred to as "nucleators"These systems have the superior quality of classical "lith" systems in addition to the good chemical stability of the conventional rapid-access systems.

Initially, the hybrid system required extremely high chemistry pH, an amine booster and a nucleator and therefore films that were designed for this chemistry could not be used in any other system. These drawbacks are being eliminated as more active nucleators are designed that allow processing at lower pH. Such nucleators are described in U.S. Pat. No. 4,269,929 (to Nothnagle) and U.S. Pat. Nos. 4,997,980, 4,686,167 and 5,220,022 (to Resnick et al.). The current family of nucleators, as described in British application 94104254 (Fryberg) filed May 24, 1994 and British application 94104007 (Fryberg) filed May 24, 1994, has sufficient activity to allow processing not only in hydroquinone but also the ascorbic acid developing systems as used in the invention.

The hybrid chemistry is truly an infectious developer in that it can develop unexposed silver halide, unlike the lith system and this accounts for the concern for peppering. The hybrid chemistry has the following mechanism:

(1) $HQ+AgX(EXPOSED)\rightarrow Q+Ag^{o}+HX$ (2) Q+Nucleator→Oxidized Nucleator (3) Oxidized Nucleator+$OH^{-}$→Hydrolyzed Nucleator (4) Hydrolyzed Nucleator+AgX(EXPOSED→$Ag^{o}$+Byproducts or UNEXPOSED)

The hydrolyzed nucleators are so active that they can be non-discriminating between the exposed and unexposed silver halide. Thus without the incorporation of restrainers or like materials and controlled process parameters, using these developing compositions can result in overdevelopment and "high fog".

In summary, the disadvantages of the lith chemistry—poor stability, high replenishment rate, poor development rate and latitude are the overriding factors in looking for alternative systems. The Rapid Access Process (RAP) chemistry, essentially eliminated these defects, but significantly deteriorated dot image quality making it unusable for generating screened halftone negatives. The hybrid system, which combines the best features of the lith and RAP technologies is the preferred system over the other systems. The ascorbic acid developing compositions provided by the present invention are effectively and preferably used in both RAP and hybrid systems.

In all three development systems, generally hydroquinones are used as the developing agent. Photographic developer compositions containing hydroquinones as developing agents are well known in the art. However due to the inherent toxicity and environmental hazards posed by hydroquinone or its derivatives, alternate developer compositions having less toxic substitutes are desirable. In replacement of the hydroquinone developing agents the art has shown use of ascorbic acid and related variations of ascorbic acid.

In particular, U.S. Pat. No. 2,688,549 to James et al. discloses a photographic developer composition and methods to accelerate the rate of developing agents. The developing agents include non-aromatic ascorbic acid and sugar analogs which contain mono-nuclear heterocyclic ene-diol groups. The developing process is accelerated by the presence of auxiliary developing agents, i.e. 1-phenyl 3-pyrazolidone.

U.S. Pat. No. 3,826,654 to Weiss et al. discloses a composition and process for developing surface latent and internal latent images. The developer composition has a pH of at least 12 and contains a 3-pyrazolidone derivative, ascorbic acid, a thione/thiol substituted nitrogen containing heterocyclic compound and alkali metal iodide.

U.S. Pat. No. 5,196,298 to Meeus et al. discloses a photographic developing composition for immersion development having a pH of at least 12 containing more than 0.45 mole/liter, preferably 0.4 to 0.9 mole/liter, of an ascorbic acid developing agent.

James, Weiss and Meeus all disclose photographic developer compositions free of hydroquinones and include ascorbic acid as a developing agent. However, Weiss and Meeus do not contain a sulfite component and the presence of sulfite is optional in James. It is advantageous to provide sulfite in the developer compositions to maintain developing activity of the compositions upon storage and reportedly acts as a silver halide sludge inhibitor during the processing of silver halide film.

U.S. Pat. Nos. 5,098,819 and 5,278,035 to Knapp disclose developing compositions including ascorbic acid as a developing agent and a sulfite component. In particular, Knapp U.S. Pat. No. 5,098,819 discloses a developer composition having a pH from 9.75 to 10.6 consisting of ascorbic acid and sugar-type derivatives thereof, their salts and mixtures thereof; a sulfite in an amount of from 2 to 20 g; an alkali metal carbonate in an amount of from 15 to 30 g; and a 3-pyrazolidone compound and water to 1.0 liter. For rapid access and hybrid systems these compositions provide poor oxidation and rates of development and in hybrid systems also provide poor dot quality.

Knapp U.S. Pat. No. 5,278,035 is limited to a non-toxic photographic developer composition for processing x-ray films in automatic film processors. Knapp '035 discloses a composition comprising a non-hydroquinone and non-alkali metal hydroxide developer for radiographic materials and a method of developing. The radiographic developer composition has a pH from 9.5 to 10.6 and comprises at least 15 grams of ascorbic acid, 2–50 grams of sulfite, a 3-pyrazolidone compound, and 35–90 grams of an "anti-swelling" agent such as sodium sulfate, glutaraldehyde or mixtures thereof and water to 1.0 liter.

U.S. Pat. Nos. 5,236,816 and 5,264,323 to Purol et al. disclose photographic developing compositions including ascorbic acid as a developing agent. The Purol U.S. Pat. No. 5,236,816 discloses a solution having a pH from 9.5 to 11.5, comprising an ascorbic acid developing agent, an auxiliary super-additive developing agent, (i.e. 3-pyrazolidone) and a carbonate buffering agent in a concentration of at least 0.5 molar. Purol U.S. Pat. No. 5,264,323 is directed to a process for forming high contrast photographic images. The process includes exposing a silver halide photographic element containing a hydrazine and amino compound component and developing in the solution described in patent '816.

The compositions in Purol are not directly dependent on the use of sulfites, which are only optionally included in the compositions at a moderate level as a preservative. In rapid access and hybrid development systems the absence of a sulfite component provides good dot quality, however stability of these compositions are limited and tend to discolor upon exposure to air.

The photographic developing composition of the present invention has a pH between 10.1 and 10.9 and contains at least 0.17 moles per liter of an ascorbic acid developing agent, 0.3 to 0.5 moles per liter of a sulfite and 0.2 to 0.4 moles per liter of a carbonate buffer. Advantage over prior art compositions are provided by the particular combination and concentrations of these constituents. The present invention is directed to the provision of such a non-toxic developing composition which may be used to effectively process both hybrid and rapid access film/paper products and provide good dot quality, greater stability and greater capacity than known developers.

Accordingly, it is a broad object of the invention to provide a photographic developing composition that is free of dihydroxybenzene developing agents and their use in the processing of photographic elements.

A more specific object of the invention is to provide a composition that includes a non-toxic developing agent such as ascorbic acid which provides environmental advantages over hydroquinone developing agents.

Another object of the invention is to provide a method that utilizes the developer compositions in processing hybrid and rapid access film/paper products.

Another more specific object of the invention is to provide a photographic development method which is an improvement over known methods, in particular the developing compositions used have a greater aerial oxidation stability, require low replenishment and provide greater capacity for developing film before exhausting.

A further specific object of the invention is to provide an ecologically safe method for processing photographic elements using the developer compositions of the invention and fixer solutions that are either ammonia-free or of a low-ammonia content.

DISCLOSURE OF THE INVENTION

In the present invention, these purposes, as well as others which will be apparent, are achieved generally by providing photographic developing compositions that are free of dihydroxybenzene developing agents. The compositions are at a pH in the range of 10.1 to 10.9 and comprise at least 0.17 moles per liter of an ascorbic acid developing agent, 0.3 to 0.5 moles per liter of a sulfite, and 0.2 to 0.4 moles per liter of a carbonate buffer.

The concentrations of the ascorbic acid developing agent, sulfite constituent and carbonate buffer are critical in the developer formulation to provide an effective developing composition for rapid access and hybrid systems. Preferably, the sulfite and ascorbic acid are present in a molar ratio of at least 1:1, where the amount of sulfite present is at least equal to or greater than the amount of ascorbic acid present. The carbonate buffer and ascorbic acid are present, preferably, in a molar ratio of at least 1:1, where the amount of carbonate buffer is at least equal to or greater than the amount of ascorbic acid.

In addition to the stated components, the compositions further include an auxiliary developing agent selected from the group consisting of pyrazolidone compounds and amino phenols. Amino boosters, antifoggants, stabilizers and sequestering agents may also be incorporated into the compositions.

The developing compositions are used for processing photographic elements in rapid access and hybrid development systems. After contact with the developer the element is contacted with a fixer solution to form a photographic image. Any conventional fixer can be used, however, it is preferable that the fixer solution be either an ammonia-free solution or have a low-ammonia content to reduce toxic by-products and thus provide a more environmentally friendly process.

Advantageously, the compositions of the invention provide good dot quality, greater aerial oxidation stability and greater capacity than known ascorbic acid developers. In addition the invention compositions provide good rates of development and require low replenishment. The developers may be used in automatic processors or tray processing applications.

Other objects, features and advantages of the present invention will be apparent when the detailed description of the preferred embodiments of the invention are considered in conjunction with the drawings, which should be construed in an illustrative and not limiting sense as follows:

BRIEF DESCRIPTION OF THE DRAWIGS

FIGS. 1A, B & C are graphic illustrations of the pH profile study from EXAMPLE I using developer formulations B, C, F and G, respectively indicating the toe to mid gradations "GTM", shoulder speed "SHLD SPEED" and minimum density "Dmin" values for processing hybrid FILM 1;

FIGS. 2A, B & C are graphic illustrations of the pH profile study from EXAMPLE I using developer formulations B, C, F and G, respectively indicating the GTM, SHLD SPEED and Dmin values for processing hybrid FILM 2;

FIGS. 3A, B & C are graphic illustrations of the pH profile study from EXAMPLE I using developer formulations B, C, F and G, respectively indicating the GTM, SHLD SPEED and Dmin values for processing hybrid FILM 3;

FIGS. 4A, B & C are graphic illustrations of the pH profile study from EXAMPLE I using developer formulations B, C, F and G, respectively indicating the GTM, SHLD SPEED and Dmin values for processing hybrid FILM 4;

FIGS. 5A, B & C are graphic illustrations of the accelerated oxidation test from EXAMPLE I using developer formulations A, B, C, D and E, respectively indicating the Dmax, SPEED and ECI values using rapid access FILM 5;

FIGS. 6A, B & C are graphic illustrations of the pH profile study from EXAMPLE II using developer formulations B, DF-1 and DF-2, respectively indicating the GTM, SHLD SPEED and Dmin values for processing hybrid FILM 1;

FIGS. 7A, B & C are graphic illustrations of the pH profile study from EXAMPLE II using developer formulations B, DF-1 and DF-2, respectively indicating the GTM, SHLD SPEED and Dmin values for processing hybrid FILM 2;

FIGS. 8A, B & C are graphic illustrations of the pH profile study from EXAMPLE II using developer formulations B, DF-1 and DF-2, respectively indicating the GTM, SHLD SPEED and Dmin values for processing hybrid FILM 3;

FIGS. 9A, B & C are graphic illustrations of the pH profile study from EXAMPLE II using developer formulations B, DF-1 and DF-2, respectively indicating the GTM, SHLD SPEED and Dmin values for processing hybrid FILM 4;

FIGS. 10A, B, C & D are graphic illustrations of the 5-day oxidation test (at 90 seconds, room temperature) from EXAMPLE III using developer formulations B, DF-1 and DF-2, respectively indicating the SPEED, ECI, Dmax and Dmin values for processing rapid access FILM 5;

FIGS. 11A, B, C & D are graphic illustrations of the 5-day oxidation test (at 2 minutes, room temperature) from EXAMPLE III using developer formulations B, DF-1 and DF-2, respectively indicating the SPEED, ECI, Dmax and Dmin values for processing rapid access FILM 5;

FIGS. 12A, B & C are graphic illustrations of the accelerated oxidation test from EXAMPLE III using developer formulations B, DF-1 and DF-2, respectively indicating the SPEED, ECI and Dmax values for processing rapid access FILM 5;

FIGS. 13A, B, C & D are graphic illustrations of the rates of development tests from EXAMPLE IV comparing developer formulations including HPMT and PMT, respectively indicating the SPEED and GTM values for processing FILM1 (FIG. A & B) and FILM 2 (FIG. C & D);

FIGS. 14A, B, C & D are graphic illustrations of the rates of development tests from EXAMPLE IV using various developer formulations of the invention, respectively indicating the SPEED and GTM values for processing FILM 1 (FIG. A & B) and FILM 2 (FIG. C & D); and FIG. 15 is a graphic illustration of the "characteristic curve" defining the relationship between LOG exposure and optical density of silver developed after processing.

DETAILED DESCRIPTION OF THE PREFERRED EMBODIMENT

Figure 1A:
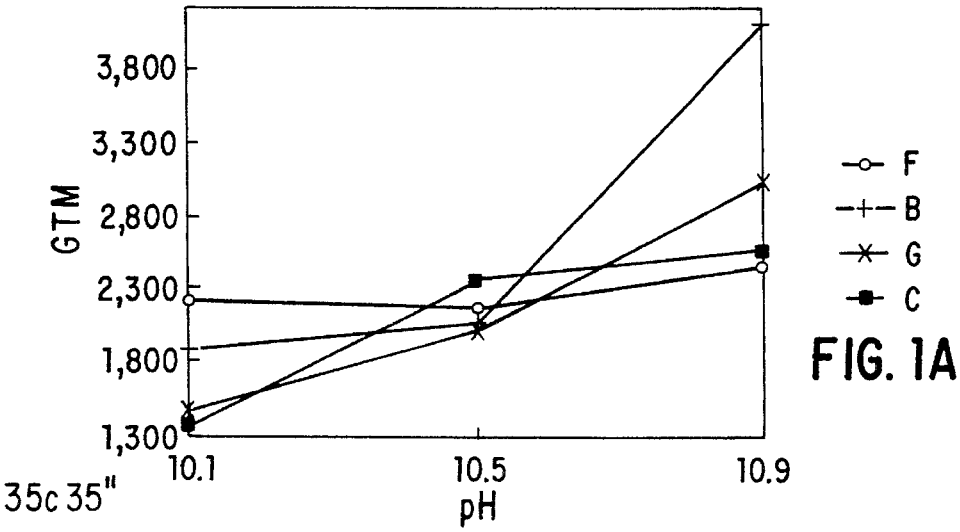

In accordance with the present invention, photographic developing compositions which are free of dihydroxybenzene (hydroquinones) developing agents is provided. The composition comprises at least 0.17 moles per liter of an ascorbic acid developing agent; 0.3 to 0.5 moles per liter of a sulfite; and 0.2 to 0.4 moles per liter of a carbonate buffer. The compositions have an alkaline pH in the range of from 10.1 to 10.9.

The ascorbic acid developing agent is selected from the group consisting of ascorbic acid, analogues of ascorbic acid, isomers of ascorbic acid, sugar-type derivatives of ascorbic acid, their salts and mixtures thereof. Preferably the ascorbic acid developing agent is L-ascorbic acid, D-ascorbic acid, their salts or mixtures thereof. The L-isomer was found to provide a faster rate of development than the D-isomer (known as Erythorbic acid) or a DL mixture. Preferably the ascorbic acid developer used in the compositions is present in the range of 30 to 50 grams per liter.

The sulfite included in the compositions may be sulfites, bisulfites, metabisulfites and carbonyl bisulfite adducts. Preferably alkali metal sulfites are used, typically either sodium sulfite or potassium sulfite. If sodium sulfite is used in the compositions, approximately 32 to 60 grams per liter is preferred. The amount of sulfite in the compositions protects the developing agents against aerial oxidation and promotes good stability characteristics.

The carbonate buffer included in the composition are alkali metal carbonates, generally, potassium or sodium carbonate. Preferably if potassium carbonate is present in the composition approximately 35 to 75 grams per liter is used.

The concentrations of the ascorbic acid developing agent, sulfite constituent and carbonate buffer are directly related to each other and are critical in the final developer formulation to provide an effective developing composition. Preferably, the sulfite and ascorbic acid developing agent are present in a molar ratio of at least 1:1, where the amount of sulfite present is at least equal to or greater than the amount of said ascorbic acid present. Also, the carbonate buffer and ascorbic acid are present, preferably, in a molar ratio of at least 1:1, where the amount of carbonate buffer is at least equal to or greater than the amount of ascorbic acid present.

In addition to the developing agent, sulfite and carbonate constituents, the compositions may further include a variety of additional components.

The compositions may further comprise auxiliary developing agents selected from the group consisting of pyrazolidone compounds and amino phenols. Dimezone S, a pyrazolidone compound, is a preferred auxiliary agent. The chemical name for Dimezone S is 4-hydroxymethyl-4-methyl-1-phenyl-3-pyrazolidinone and is commercially available from Eastman Kodak Company, 343 State Street, Rochester, N.Y., 14650 or as "IRGAFORM 1266"from Ciba-Geigy Corporation, Plastics & Additives Division, Three Skyline Drive, Hawthorne, N.Y. 10532. In addition, Metol, which is a substituted amino phenol is another preferred material. The chemical name for Metol is p-methyl-aminophenol sulfate and is available commercially from Charkit Chemical Corporation, 1063 Post Road, P.O. Box 1725, Darien, Conn., 06820 or from Aldrich Chemical Co., Inc. P.O. Box 355, Milwaukee, Wis., 53201. Hydrazine compounds other than pyrazolidone, i.e. phenidone, may also be incorporated into the compositions. Preferably from 0.0015 to 0.0063 moles per liter of the auxiliary developing agent selected.

As discussed earlier in the specification, the hybrid development chemistry includes the presence of a nucleator, which according to the proposed mechanism is oxidized and hydrolyzed during the processing of silver halide film. Generally, nucleators are hydrazine and hydrazine derivatives which may be incorporated into the developing compositions or the photographic element to promote high contrast. Nucleators which may be incorporated into the invention compositions are described in U.S. Pat. No. 4,269,929 (to Nothnagle) and U.S. Pat. Nos. 4,997,980, 4,686,167 and 5,220,022 (to Resnick et al.) the substance of each patent being incorporated by reference in its entirety with regard to such discussion. The nucleators described in these patents are representative of the nucleators used in processing hydroquinone developing systems but are also effective in the ascorbic acid developing systems of the invention with appropriate adjustments to the processing conditions. Recent developments have provided a family of nucleators which have sufficient activity to allow processing not only with hydroquinone but also the ascorbic acid developing systems at lower more desirable pH levels. Representative of such nucleators which may be used in the compositions are described in British application 94104254 (Fryberg) filed May 24, 1994 and British application 94104007 (Fryberg) filed May 24, 1994 and are incorporated herein by reference.

As stated in Nothnagle, the hydrazine compounds ("nucleators") were developed as an alternative to using a "lith" type developer with a low sulfite content to achieve a high contrast (typical "lith" system). However, in order to get maximum contrast from use of the hydrazine compound the compositions typically have a high pH of about 11.0 or greater. At high pH the effective life of the developing solutions are short. However, combination of nucleators with an amino booster, or use of the recently developed family of nucleators, can permit use of a reduced pH level while retaining the desired high contrast characteristics.

Amino boosters may be included in the compositions. Representative amino boosters used in the invention are described in European patent application no. 90119617.0 (to Fuji), published Apr. 17, 1991, publication no. 0422677 A1, which is incorporated herein by reference. The inclusion of an amine also in the present non-hydroquinone systems act as an antisludging agent. A preferred amino booster which may be used in the compositions is n-benzyl, n-methylamino ethoxyethoxyethanol.

Antifoggants or fog restrainers are agents that decrease the rate of fog density growth during development to a greater degree than they decrease the rate of image growth. Stabilizers are agents that decrease the changes in developable fog and/or in other sensitometric characteristics of the emulsion coating that occur during storage (aging). Some agents act in both capacities and their action generally depends on the concentration as well as the chemical composition of the agents.

Antifoggants such as phenylmercaptotetrazole "PMT", P-hydroxy phenylmercaptotetrazole "HPMT" and benzotriazole are used in the compositions to inhibit the development of unexposed grains in the photographic emulsion and therefore prevent undesired density in areas where no image is required.

PMT is a commonly used additive in photographic developers. However, in the present compositions, it was unexpectedly found that the derivative p-hydroxy phenylmercaptotetrazole (HPMT), performed better than PMT with regard to the rates of development. At low pH HPMT gives a superior Dmax and at elevated pH it produces lower stain than PMT. Thus incorporation of HPMT into the composition formulations was desirable.

Soluble bromide is a common antifoggant for use in developers and also acts as a stabilizer. Other inorganic agents which act as antifogging and stabilizers include complex salts of group VIII of the periodic table and salts of mercury, cadmium, zinc and manganese. In addition, salts of gold, platinum and iridium can act as fogging or antifogging agents during chemical sensitization of the emulsion.

Unlike the organic antifoggants, the halide ions are relatively weakly adsorbed on silver (apart from iodide ions) and the effect on development rate occurs at the silver halide surface, which adsorbs halide ions from solution. The adsorbed ions and excess ions in the solution reduce the silver ion activity at the surface and in the vicinity of a grain and thus decrease the reduction rate.

Other additional components to the compositions may include boric acid, which may be added for stability and to enhance the shelf life of the compositions. Sodium bromide or potassium bromide is included in the compositions and functions as a restrainer.

Sequestering agents such as an amino substituted tetraacetic acid derivative may also be incorporated into the compositions to sequester any heavy metals present in solution. The sequestering agents used in the compositions include ethylenediamine tetraacetic acid (EDTA), 1,3 diamino-propan-2-ol tetraacetic acid (DAPTA) and nitrilotriacetic acid (NTA). However, diethylenetriaminepentaacetic acid (DTPA), is preferred for environmental reasons.

The composition formulations are aqueous solutions but in an alternate embodiment may be provided in dry powder form. The dry constituents are equivalent to at least 0.17 molar of an ascorbic acid developing agent; 0.3 to 0.5 molar of a sulfite selected from the group consisting of sodium sulfite and potassium sulfite; and 0.2 to 0.4 molar of a carbonate buffer selected from the group consisting of sodium carbonate and potassium carbonate. Water is added to said dry constituents to form a developing composition with a pH in the range of from 10.1 to 10.9.

The compositions are made by blending the ascorbic acid developer, sulfite and carbonate components in the specified concentrations. A key feature in the process is that the order of addition of the components is critical. The ascorbic acid is added after the sulfite and carbonate components. The particular sulfite concentration range of the composition is necessary, since at high concentrations the gradation of the sensitized product is adversely affected while at low concentration the aerial stability of the chemistry is compromised. The preferred sulfite concentration is in the range 0.3 to 0.5 moles per liter and if sodium sulfite is used approximately 32 to 60 grams/liter are present in the compositions. Typically, diethylene glycol (DEG) is used as a solvent for the organic components, however any similar photographically inert solvent may be used.

A preferred composition at pH 10.4 to 10.9 includes a sequestering agent, sodium sulfite, potassium carbonate, ascorbic acid, a nucleator, antifoggant, stabilizer and HPMT in the preferred concentration ranges stated herein.

The composition formulations can be used to process two types of film/paper products i.e. rapid access processing (RAP) and hybrid materials. Advantages of the present formulation over known photographic developing compositions are in the use of a relatively non-toxic developing agent (ascorbic acid) and provision of a formulation in powder form.

The photographic developer compositions are used in a method for processing photographic elements. This method is advantageous over prior art practice in the provision of an ecologically safe method for processing photographic elements. The element is film or paper. In general, the photographic element is contacted with the invention developing compositions under standard processing conditions. The compositions can be used in automatic processors or tray development applications. After contact with the developer the element is contacted with a fixer solution to form a photographic image on the element. Any conventional fixer can be used. However, it is preferable that the fixer solution be either an ammonia-free solution or having a low-ammonia content to reduce toxic by-products and provide a more environmentally friendly process. A low-ammonia content fixer solution used in the invention preferably includes approximately 50% or less ammonia.

The following examples and data illustrate various aspects of the invention but are not to be interpreted as limiting it. Example I illustrates the application of the developing compositions in hybrid and rapid access development systems; Example II illustrates comparative tests of the developing compositions of the invention and prior art developers; Example III illustrates the advantage of incorporating HPMT into the compositions; Example IV illustrates the rates of development for the invention compositions; and Example V sets forth a dot quality analysis illustrating the effectiveness of the compositions on hybrid film.

DEVELOPER FORMULATIONS A–S

The following developer compositions designated A to S set forth in the TABLE I below were prepared in accordance with the present invention. The formulations may also include additional components such as PMT or HPMT not indicated in TABLE I. These compositions were subject to tests described in EXAMPLES I to V to illustrate the advantages of the compositions.

| | | |
|---|---|---|
| Key: | AA | Ascorbic Acid |
| | DS | Dimezone S |
| | PEO AMINE | n-benzyl, n-methylamino ethoxyethoxy-ethanol |
| | $K_2CO_3$ | Potassium carbonate |
| | D | Dimezone |
| | ▲DAPTA | 1,3 diaminopropan-2-ol tetraacetic acid |
| | $Na_2SO_3$ | Sodium Sulfite |
| | PHEN | Phenidone |
| | DTPA | diethylenetriaminepentaacetic acid |
| | $H_3BO_3$ | Boric Acid |
| | Na ERY | Sodium Erythorbate |

TABLE I

DEVELOPER COMPOSITIONS A THROUGH S

| DEVELOPER | AA | $K_2CO_3$ | $Na_2SO_3$ | $H_3BO_3$ | DS | Na ERY | PEO AMINE | D | PHEN | DTPA |
|---|---|---|---|---|---|---|---|---|---|---|
| A | 30 | 55 | 44 | — | 1 | — | — | — | — | 2.4 |
| B | 40 | 55 | 44 | — | 1 | — | — | — | — | 2.4 |
| C | 50 | 35 | 60 | — | 1 | — | — | — | — | 2.4 |
| D* | 40 | 55 | 44 | — | 1 | — | — | — | — | 2.4 |
| E | 40 | 55 | 44 | — | 1.3 | — | — | — | — | 2.4 |
| F | 30 | 55 | 44 | 5 | 1 | — | 0.62 | — | — | 2.4 |
| G | — | 55 | 44 | 5 | 1 | 33.75 | 0.62 | — | — | 2.4 |
| H | 30 | 55 | 44 | 5 | — | — | 0.62 | 0.92 | — | 2.4 |
| I | 30 | 55 | 44 | 5 | — | — | 0.62 | — | 0.79 | 2.4 |
| J | 40 | 55 | 52 | — | 1.3 | — | — | — | — | 2.4 |

TABLE I-continued

| DEVELOPER | AA | $K_2CO_3$ | $Na_2SO_3$ | $H_3BO_3$ | DS | Na ERY | PEO AMINE | D | PHEN | DTPA |
|---|---|---|---|---|---|---|---|---|---|---|
| | DEVELOPER COMPOSITIONS A THROUGH S | | | | | | | | | |
| K | 40 | 55 | 44 | — | — | — | — | 0.92 | — | 2.4 |
| L | 40 | 55 | 44 | — | 1 | — | — | — | — | 1.966▲ |
| M | 30 | 55 | 44 | 5 | 0.7 | — | — | — | — | 2.4 |
| N | 30 | 55 | 44 | 5 | 1.3 | — | — | — | — | 2.4 |
| O | 40 | 55 | 44 | — | 1.0 | — | 0.62 | — | — | 2.4 |
| P | 50 | 55 | 52 | — | 1.3 | — | — | — | — | 2.4 |
| Q+ | 40 | 55 | 44 | — | 1.0 | — | — | — | — | — |
| R | 30 | 55 | 44 | — | 1.0 | — | — | — | — | 2.4 |
| S | 40 | 75 | 32 | — | 1.0 | — | — | — | — | 2.4 |

Concentration of ingredients are in grams per liter
*pH replenisher in this example was 0.2 units higher than the working tank
+ No sequestering agent present in composition

EXAMPLE I

In this example the developer compositions illustrated in TABLE I were tested for their effectiveness in hybrid and rapid access development systems. Oxidation tests and pH studies were performed to illustrate the stability, capacity and characteristics of the developing compositions.

HYBRID FILM PROCESSING

Developer compositions B, C, F and G, from TABLE I, were tested on the four different hybrid films, labeled FILM 1, 2, 3 and 4. All four compositions include at least ascorbic acid, carbonate, sulfite, an auxiliary developing agent and a sequestering agent. Compositions F and G additionally contain boric acid and PEO amine as an amino booster.

FILM 1 is a hybrid film commercially available as Camera 2000 (CGP) from Eastman Kodak Company, 343 State Street, Rochester, N.Y., 14650. The film includes a hydrazine nucleating agent and an amino booster. FILMS 2, 3 and 4 are similar to FILM 1 and contain a hydrazine nucleating agent (NUCLEATOR 1 or 2) but do not contain an incorporated amino booster. The structures for NUCLEATORS 1 and 2 are listed below. NUCLEATOR 1 is 4-Dimethylamino-1-[2-[3-methyl-4-[2-[2-(methylamino)-1,2-dioxoethyl]hydrazino]phenylamino]-2-oxoethyl]pyridinium chloride. NUCLEATOR 2 is 4-(1-butyl-1-pentyl)-1-(3-[2-(2-hydroxymethylbenzoyl)-1- hydrazino] phenylamino]2-oxoothyl]pyridinium chloride. The specific nucleators used in the examples are representative of the nucleators which may be used, other nucleators may be substituted and are encompassed by the invention.

NUCLEATOR 2

The charts below describe the components of FILMS 2, 3 and 4 used in the examples, specifically the emulsion layer (Layer 1) and surface layer (Layer 2) components are described.

| LAYER 1 - EMULSION LAYER (units in grams/meter$^2$) | | | |
|---|---|---|---|
| COMPONENT | FILM 2 | FILM 3 | FILM 4 |
| SULFUR/GOLD RIPENED AgClBr (70:30), 0.27μ | 5.10 | 5.10 | 5.10 |
| GELATIN | 2.42 | 2.42 | 2.42 |
| SUBSTITUTED BENZIMIDAZOLOCARBOCYANINE DYE | 0.002 | 0.001 | 0.001 |
| [(SUBSTITUTED THIAZOLINYLIDENE) ETHYLENE]RHODAMINE DYE | 0.0016 | 0.0008 | 0.0008 |
| 5-METHYL 7-HYDROXY-TRIAZAINDOLIZINE | 0.0243 | 0.0243 | 0.0243 |
| PHENYL MERCAPTO-TETRAZOLE | 0.004 | 0.004 | 0.004 |
| POLYSTYRENE SULFONIC ACID | 0.342 | 0.342 | 0.342 |
| NUCLEATOR 1 | 0.009 | — | — |
| NUCLEATOR 2 | — | 0.014 | 0.014 |

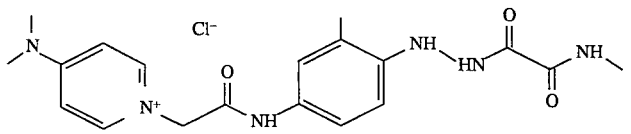

NUCLEATOR 1

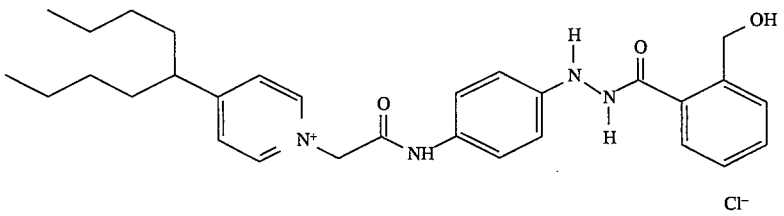

NUCLEATOR 2

| LAYER 2 - SURFACE LAYER (units in grams/meter$^2$) | | | |
|---|---|---|---|
| COMPONENT | FILM 2 | FILM 3 | FILM 4 |
| GELATIN | 1.200 | 1.200 | 1.200 |
| SURFACTANT | 0.004 | 0.004 | 0.004 |
| HYDROQUINONE | 0.240 | 0.240 | 0.240 |
| MATTE | 0.005 | 0.005 | 0.005 |
| SODIUM METABISULFITE | 0.003 | 0.003 | 0.003 |
| DIMEZONE S | 0.048 | 0.048 | 0.048 |
| TRIAZENE HARDENER | 0.04 | 0.04 | 0.04 |

Processing of the film in each instance was done at standard processing conditions of 35° C. and 35 seconds.

Figure 15:
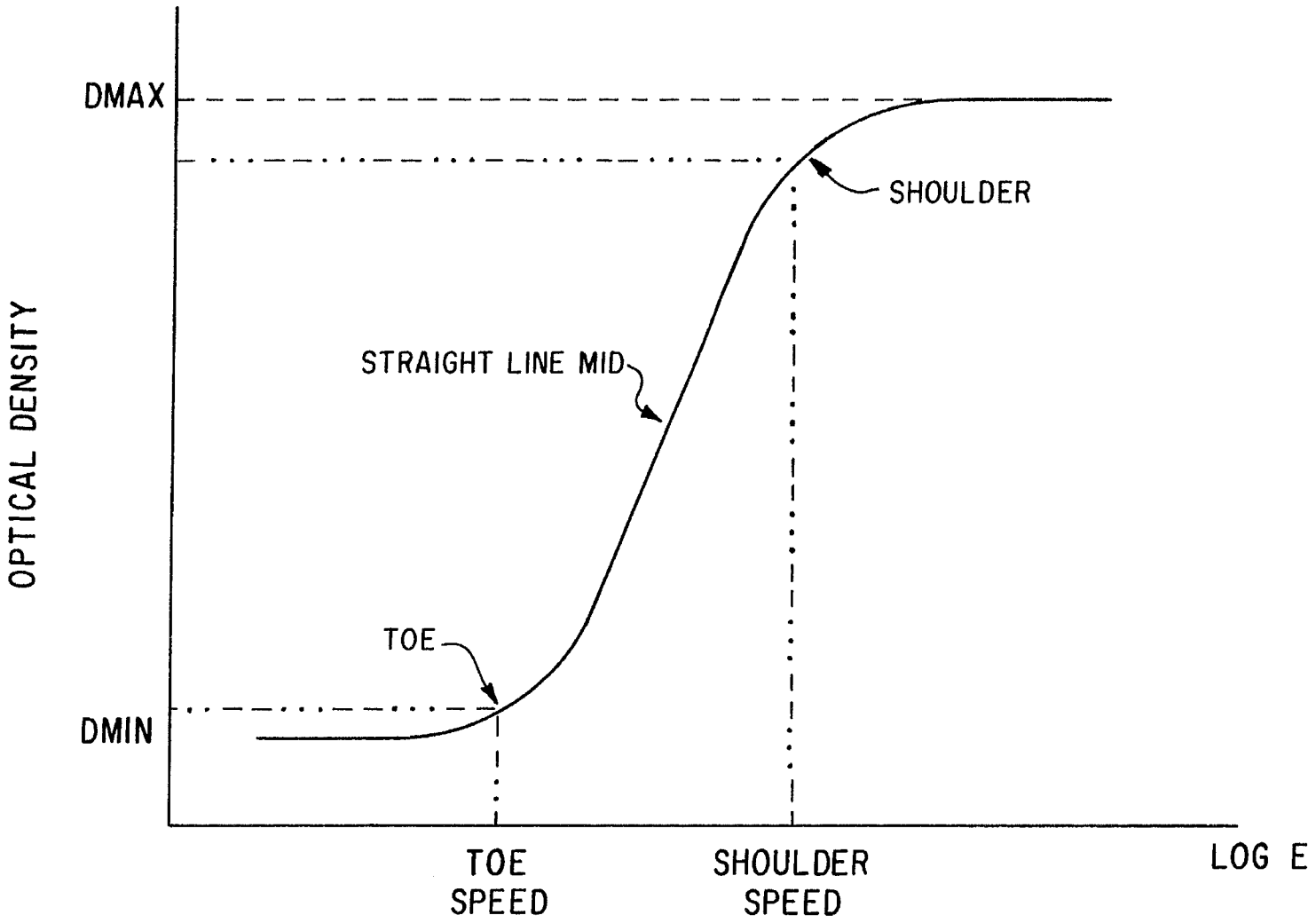

A study was performed at pH 10.1, 10.5 and 10.9 in which the toe to mid gradation "GTM" shoulder speed "SHLD" and minimum density "Dmin" values for each of the cited compositions and films were measured. As used in the specification herein GTM, SHLD Speed and Dmin values are defined as follows and illustrated in the "characteristic curve" illustrated below. GTM-toe to mid gradation; slope of the curve between 0.1 and 2.5 density units; SHLD-shoulder speed; speed value taken at 3.5 density units. (The smaller the number the faster the film); and Dmin-minimum density or base density. These terms are commonly known and used in the art. Reference is made to James, Chapter 17, *Sensitometry of Black-White Materials*, "Characteristic Curves", pp. 501–503 and Neblette, "The D LOG E Curve" *Photographic Sensitometry*, pp. 259–261. Essentially, when a light-sensitive element is subjected to light it receives an exposure (E) equivalent to the product of the intensity (I) of the light multiplied by the time (t) of the exposure: E=I×t. Hurter and Driffield defined a relationship between the LOG Exposure and the optical density of silver developed after processing. This relationship is exhibited in the "characteristic curve" illustrated in FIG. 15.

Typically gamma (gradient) is given as the slope of the straight line portion but gamma can be measured between any two speed points, e.g. toe-mid, toe-shoulder.

A preferred result for a developer composition is where there is a high gradation (GTM), a fast shoulder speed (SHLD) and a low Dmin value.

Figure 1B:
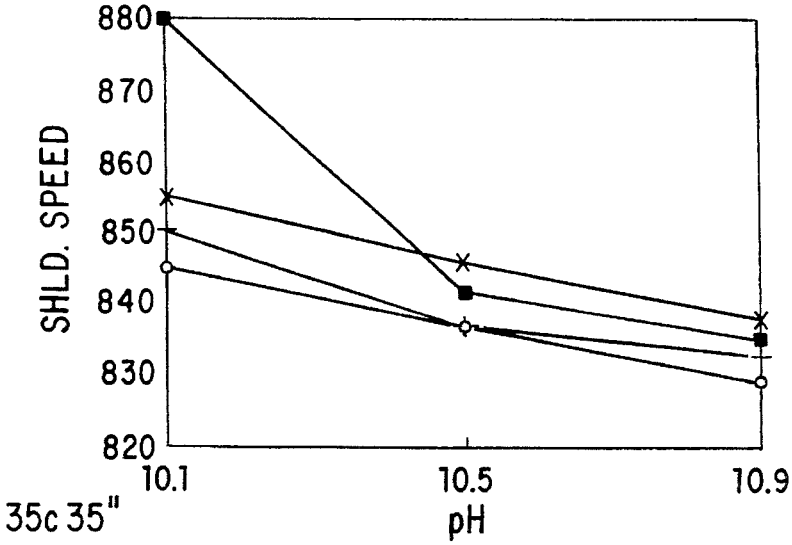
Figure 1C:
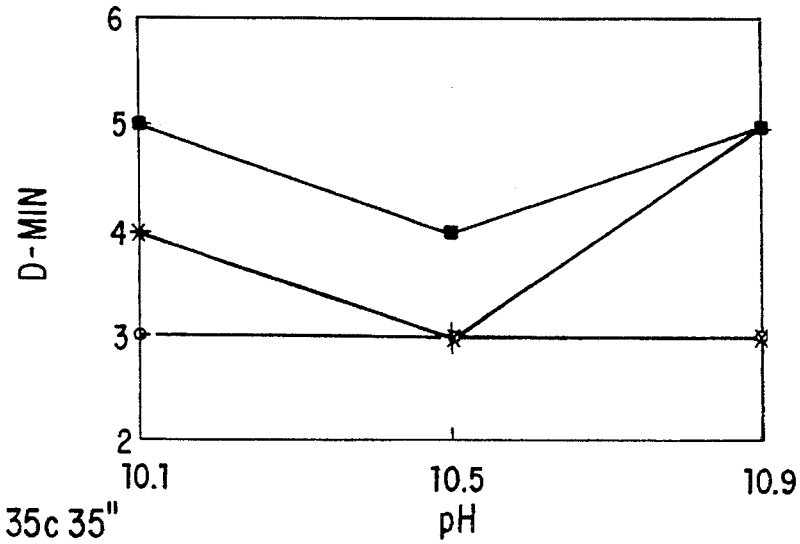
Figure 2A:
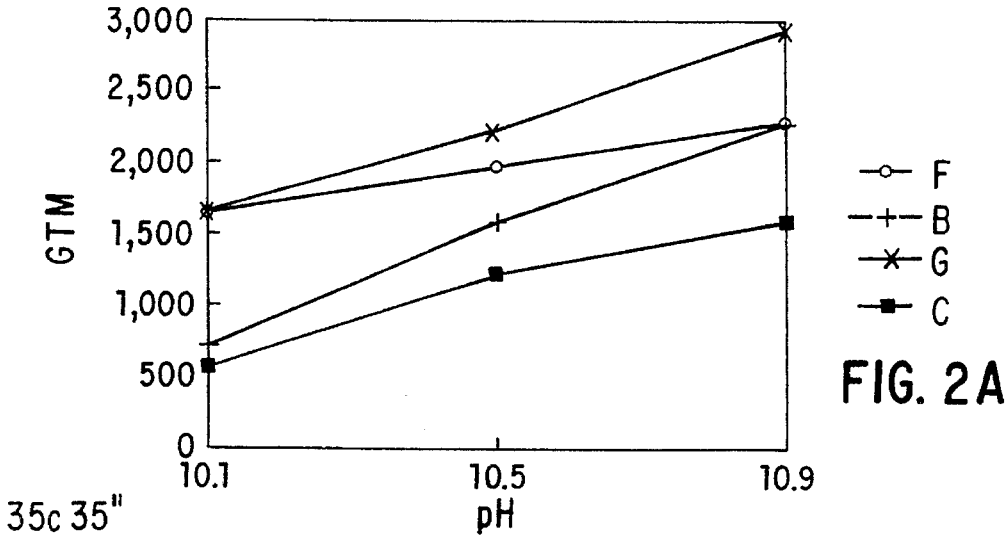
Figure 2B:
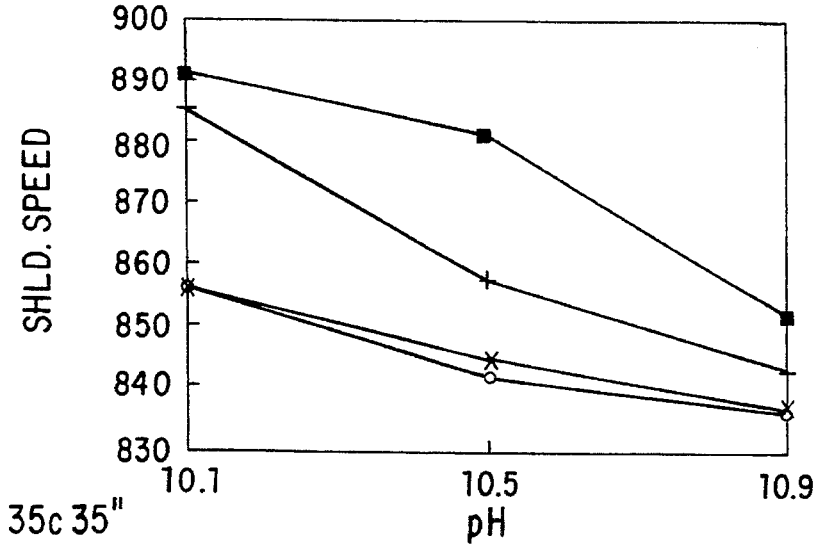
Figure 2C:
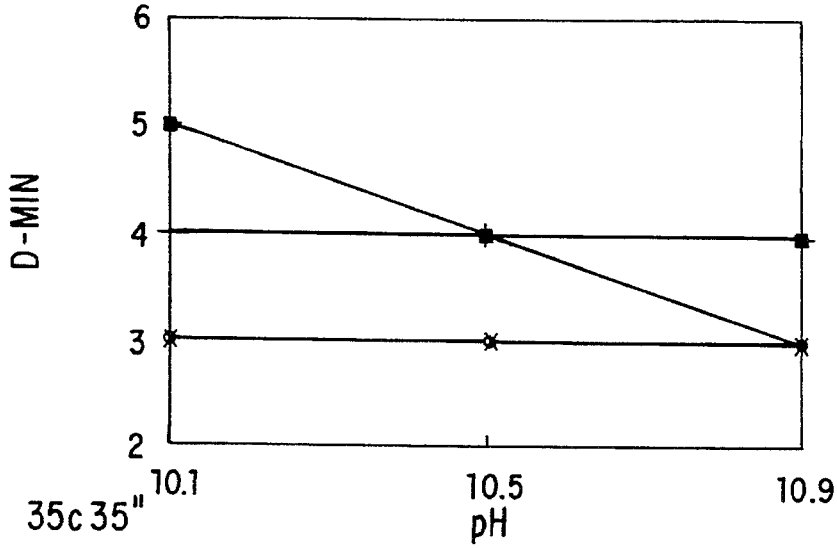
Figure 3A:
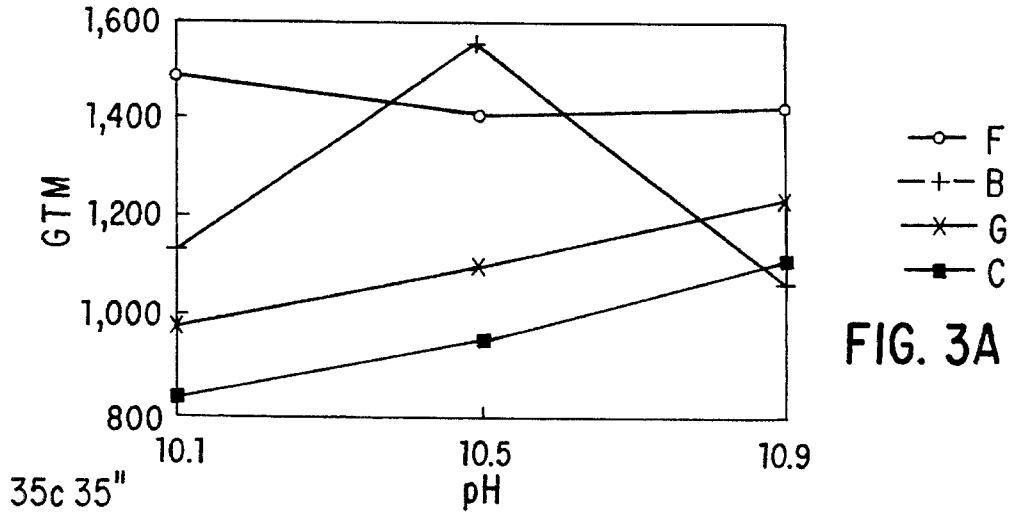
Figure 3B:
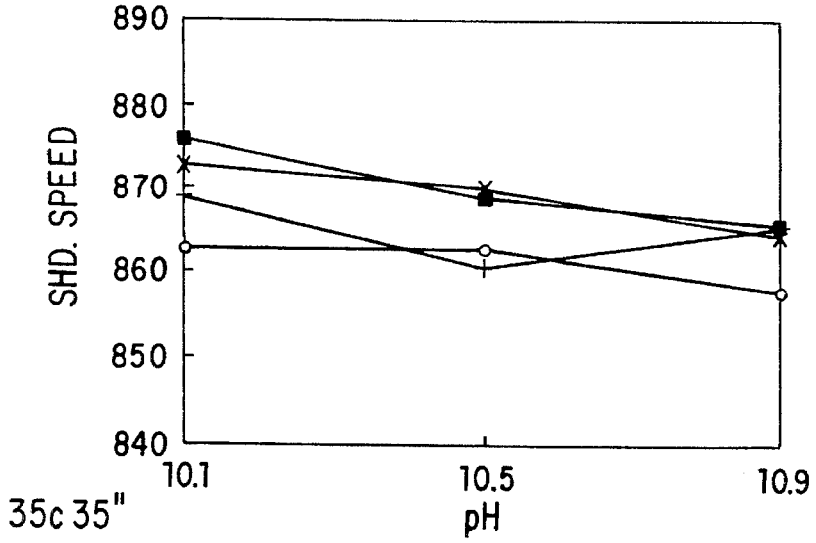
Figure 3C:
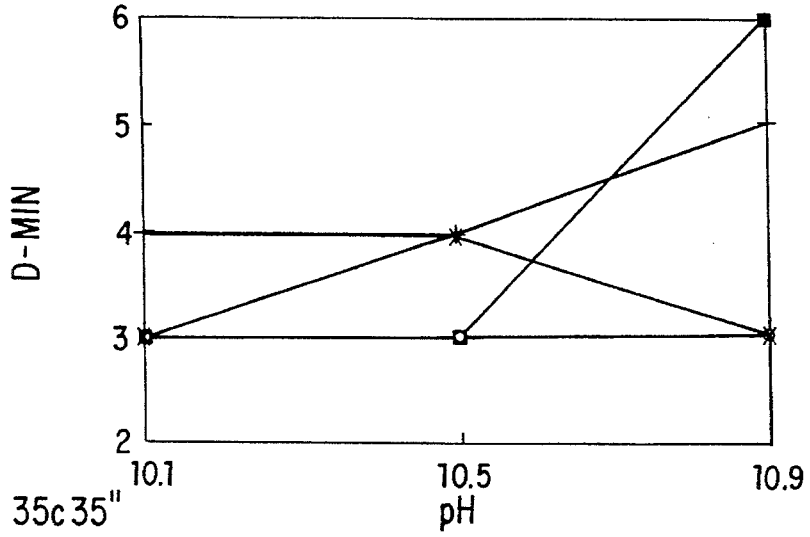
Figure 4A:
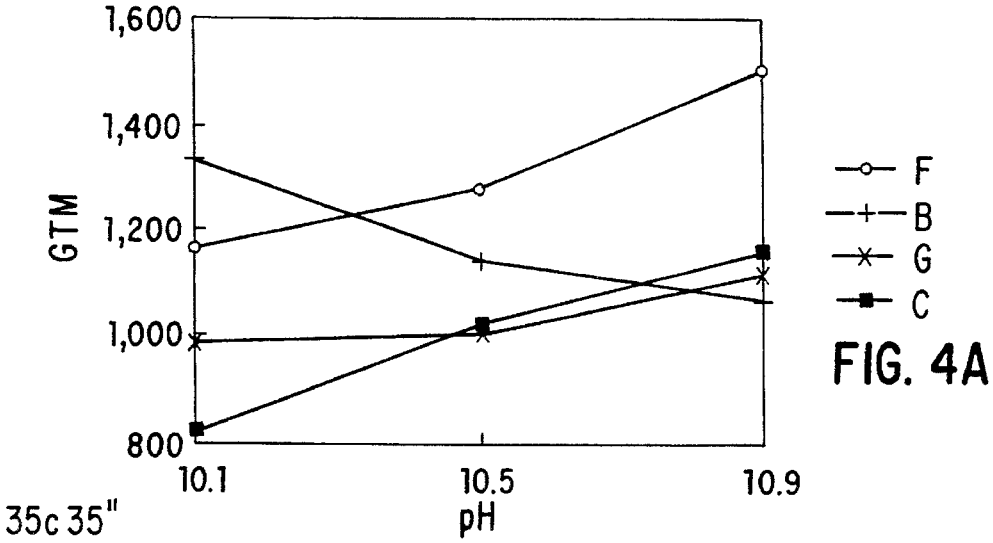
Figure 4B:
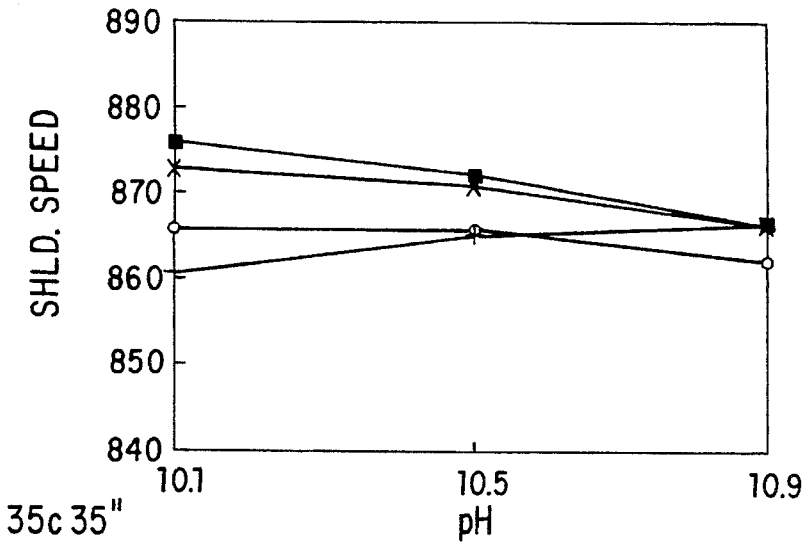
Figure 4C:
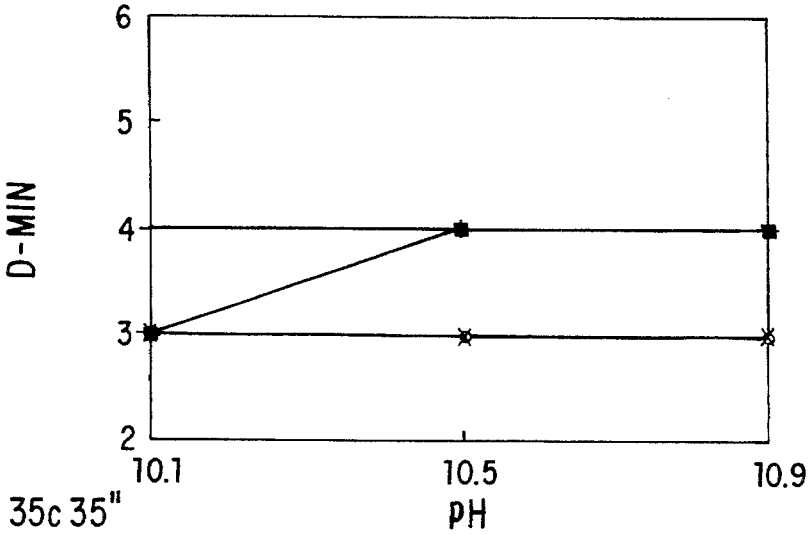

The results of the pH profile study are illustrated in the graphs of FIGS. 1A, 1B & 1C (FILM 1); 2A, 2B & 2C (FILM 2); 3A, 3B & 3C (FILM 3) and 4A, 4B & 4C (FILM 4). The A, B & C plots, respectively for each of the FIG., represent the GTM, SHLD SPEED and Dmin values for each of the compositions used in processing the films.

RAPID ACCESS FILM PROCESSING

An accelerated oxidation test was conducted using developer composition formulations A, B, C, D and E from TABLE I. All the compositions include at least an ascorbic acid, carbonate, sulfite, an auxiliary developing agent and a sequestering agent. This oxidation test gives an indication as to the general stability of the compositions when used under conditions of low or non replenishment.

Rapid access film control strips (FILM 5) commercially available as Repromatic Control Strips from Anitec Image Corporation, 40 Charles Street, Binghamton, N.Y., 13902-4444 were used to monitor the developer compositions. Processing conditions were at 35° C. for 32 seconds.

The compositions were allowed to oxidize under controlled conditions in a Cordell Processor model #CE14 manufactured by Cordell Engineering, Inc., 6 Centennial Drive, Peabody, Mass., 01960, for up to 5 days. Typically, hydroquinone based chemistries generally last 4–5 days and known ascorbic acid based chemistries have been found to last 2–4 days.

Figure 5A:
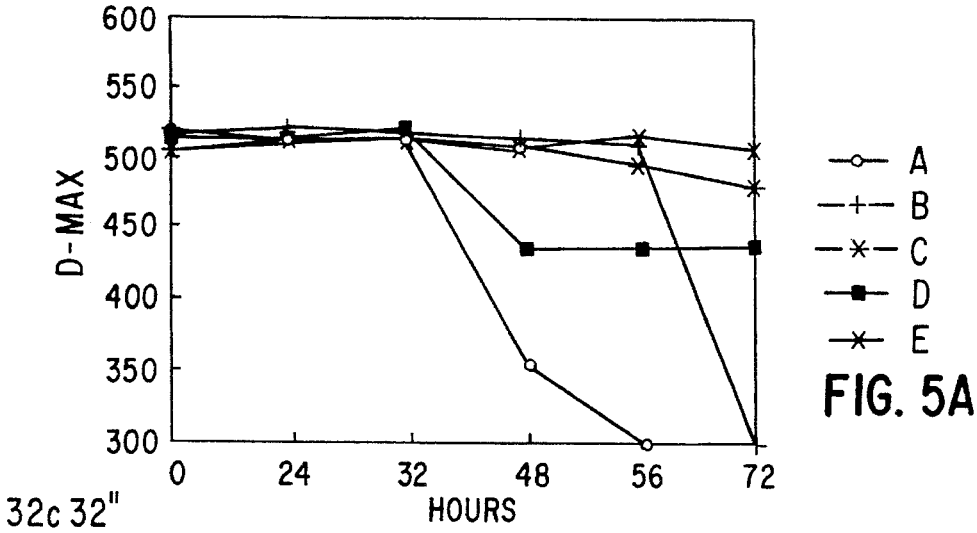
Figure 5B:
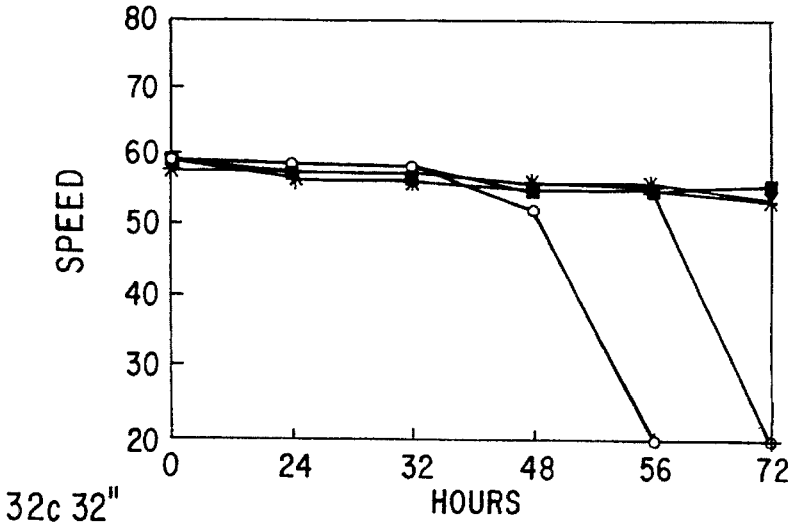
Figure 5C:
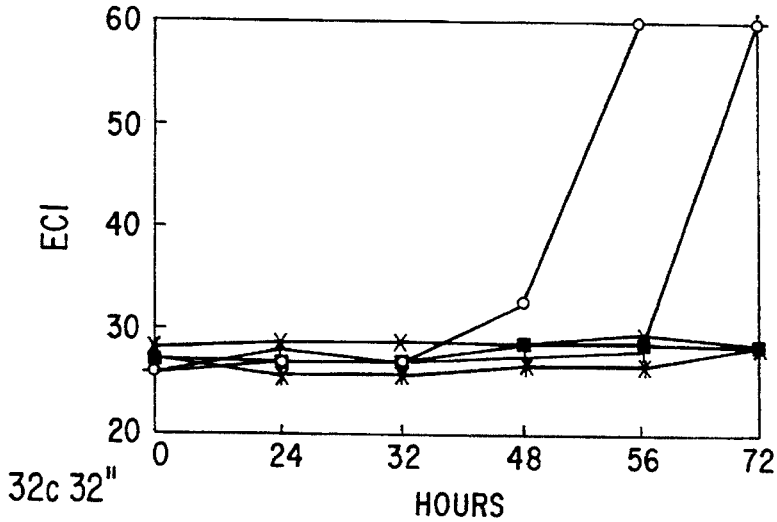
Figure 6A:
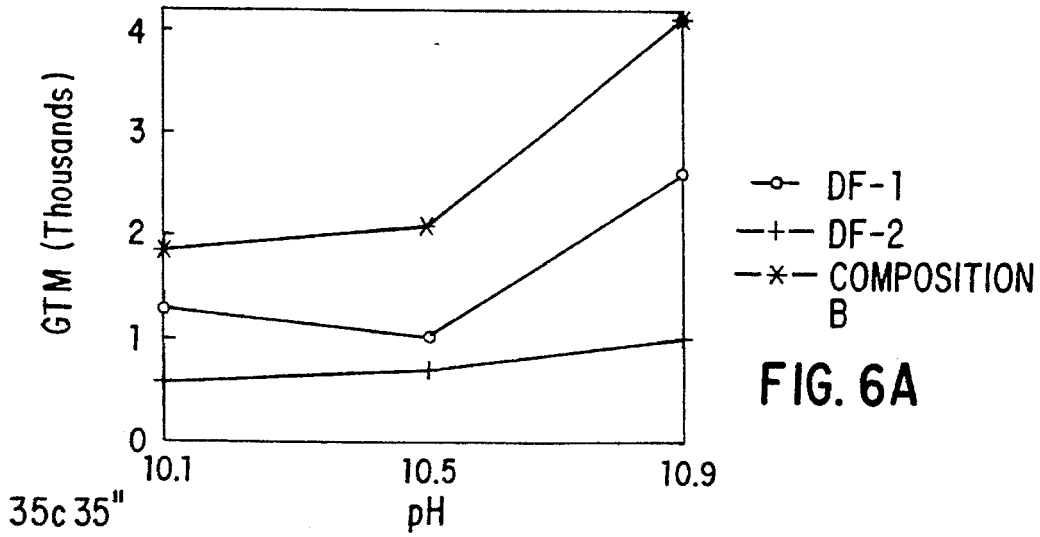
Figure 6B:
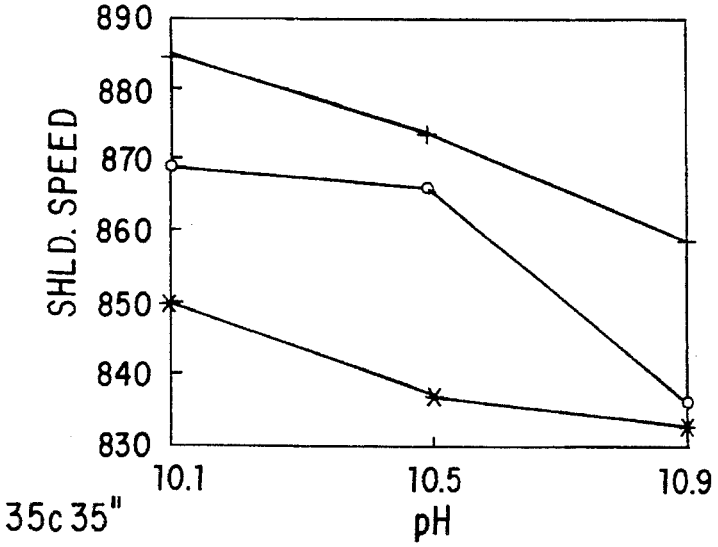
Figure 6C:
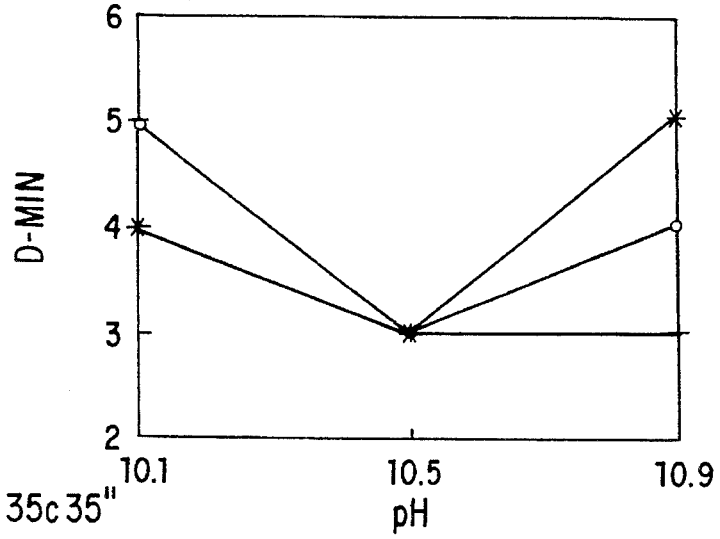
Figure 7A:
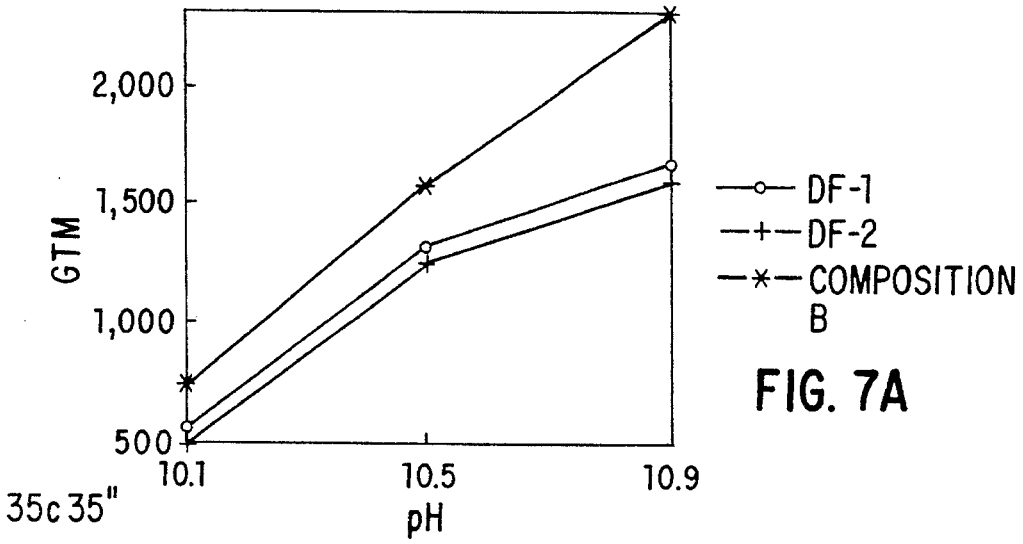
Figure 7B:
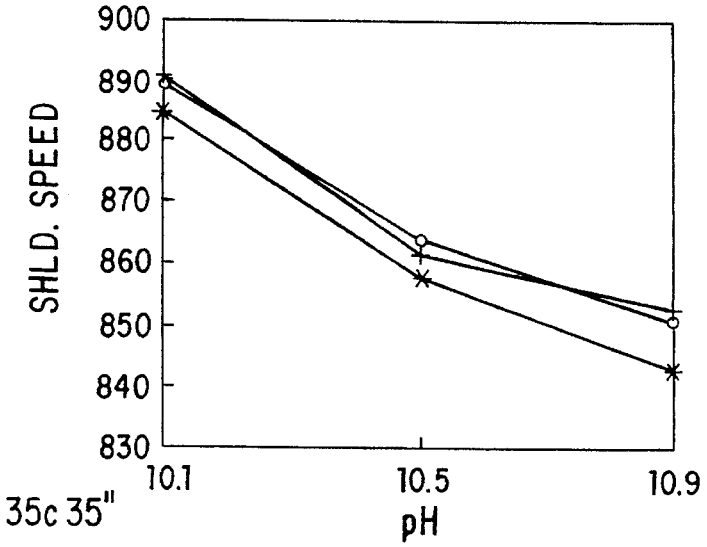
Figure 7C:
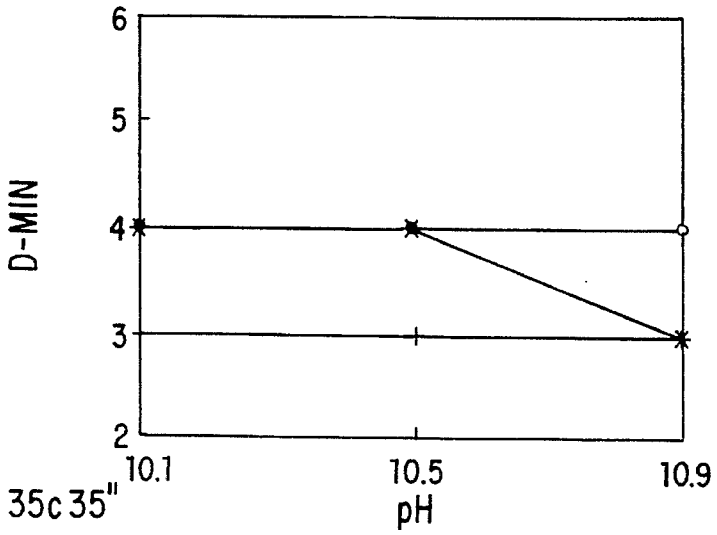
Figure 8A:
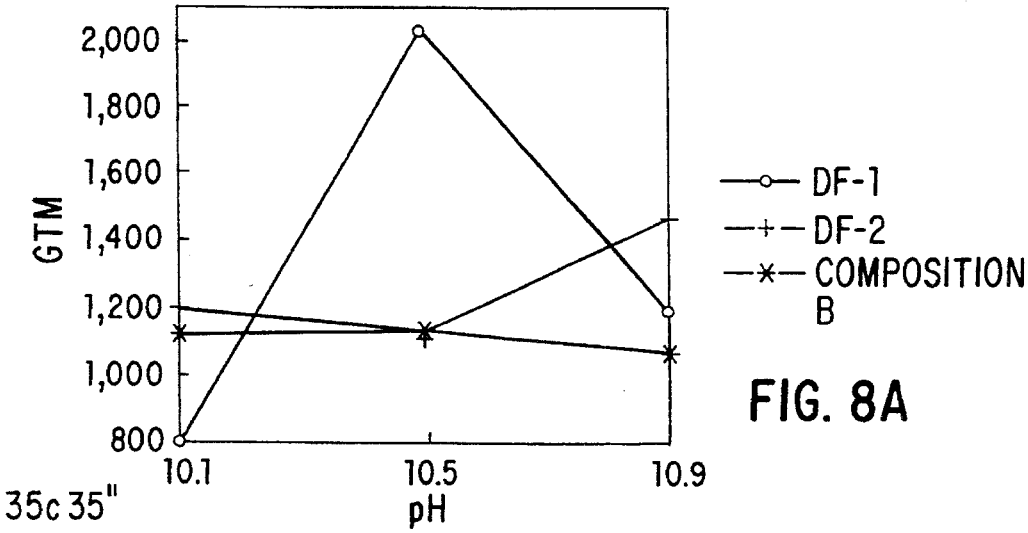
Figure 8B:
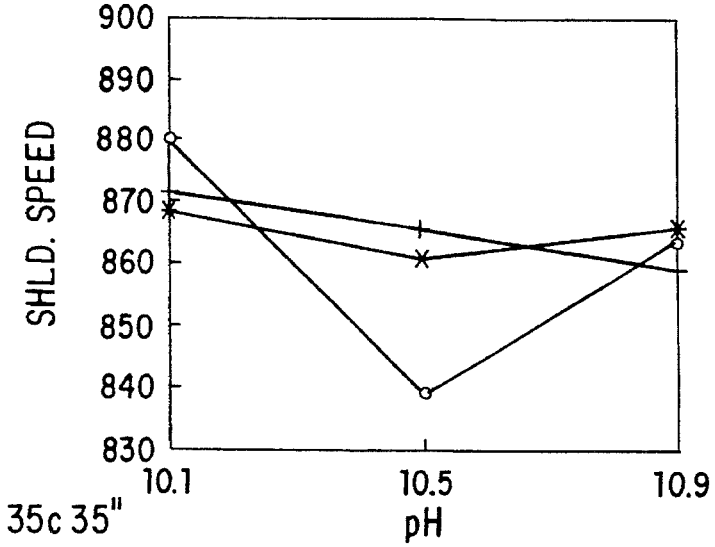
Figure 8C:
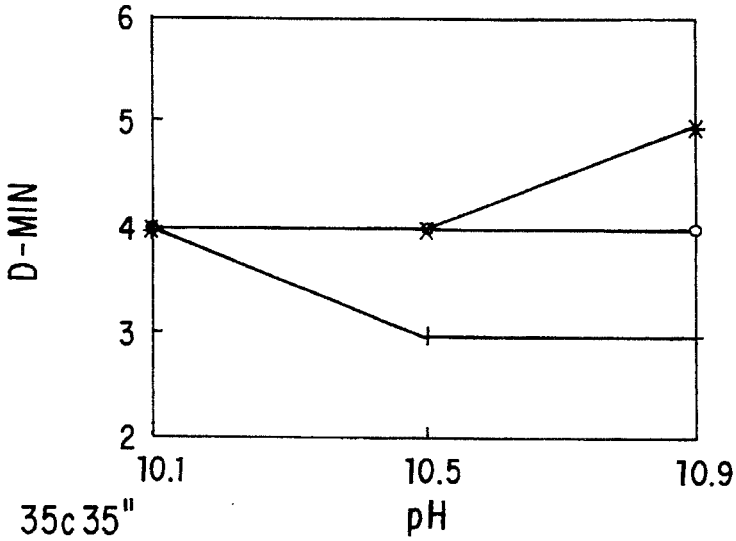
Figure 9A:
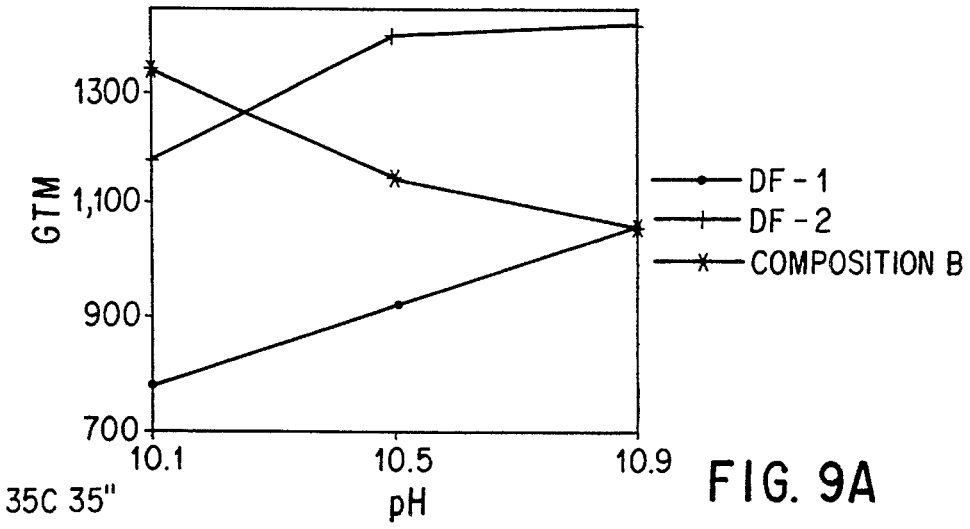
Figure 9B:
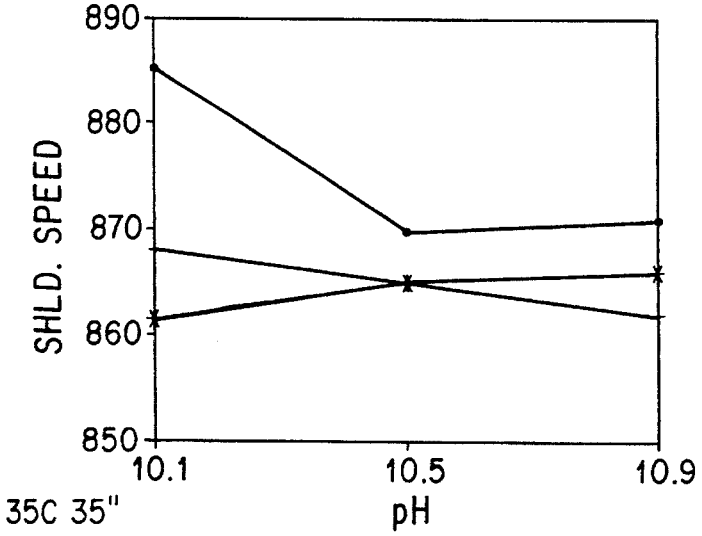
Figure 9C:
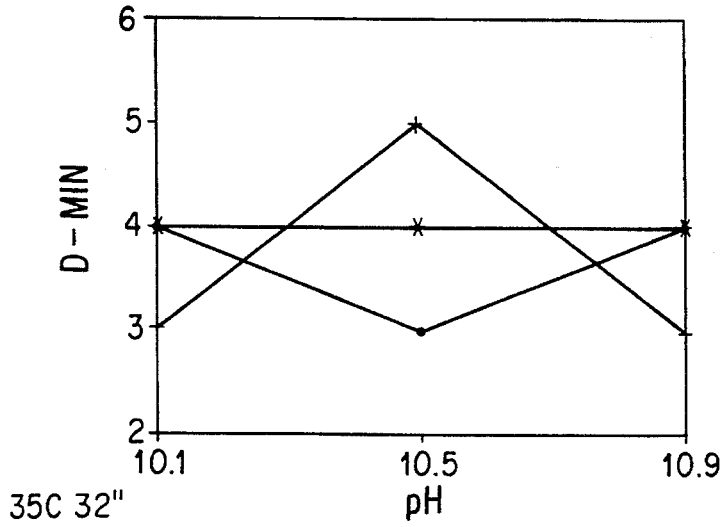
Figure 11A:
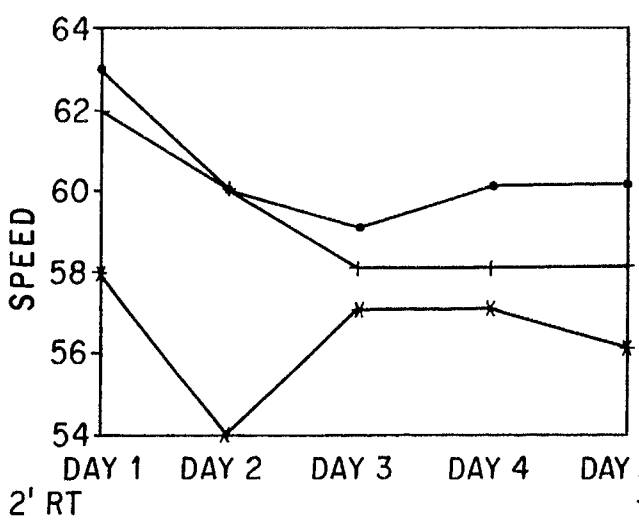
Figure 11C:
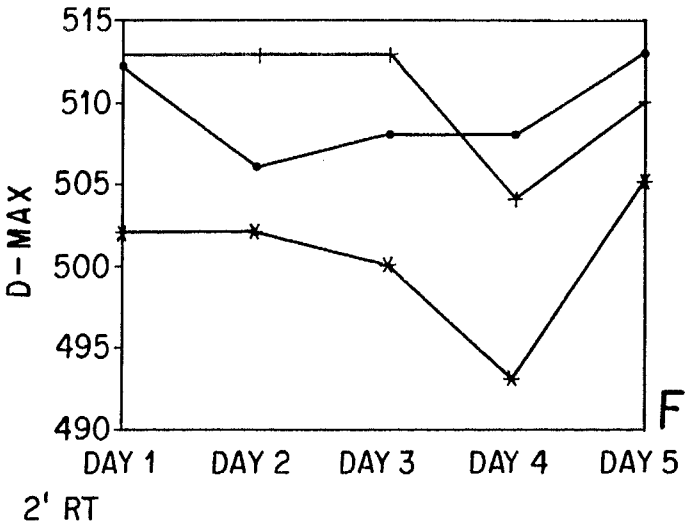
Figure 11B:
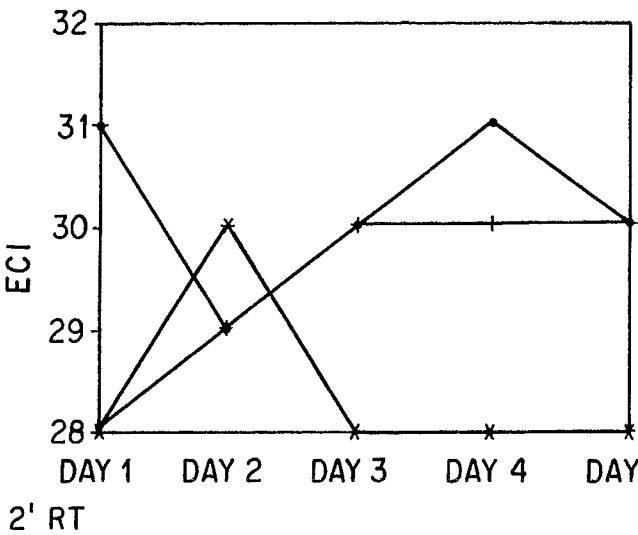
Figure 11D:
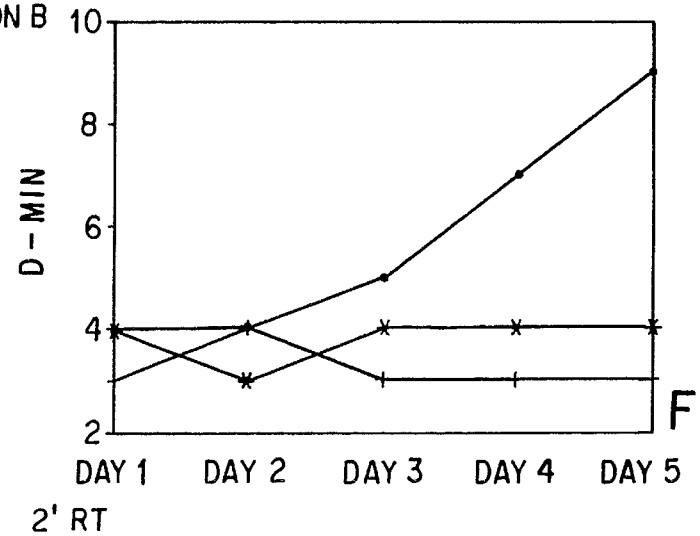

The results of the oxidation test are illustrated in FIG. 5. In particular FIG. 5A shows the maximum density (Dmax) values over a course of 72 hours; FIG. 5B shows the Speed values over the same time period and FIG. 5C shows the effective contrast index (ECI) over the same time period. The ECI is another way to measure the steepness or contrast of a photographic element. In this specification it is taken as the difference in LOG Exposure values between two speed points. So that ECI values decrease as the element provides higher contrast, i.e. the speed points for a "contrasty" film are closer along the LOG Exposure scale than a "flat" film.

The speed values were obtained at 3.50 density units. However, these values are the reciprocal of the speed values illustrated in FIG. 1B, 2B, 3B and 4B. Thus in FIG. 5B the higher the number the more active the developer composition. In FIG. 5C the ECI is plotted as the LOG Exposure difference measured from 0.2 to 3.5 density units. As indicated from the graph with the loss in developer activity the ECI number increases.

From all the pH profile studies and the oxidation tests performed, composition B was preferred overall in both the hybrid and rapid access systems. Overall, however, all the compositions tested provide a chemistry that is both rapid access and hybrid film processable.

EXAMPLE II

Comparative tests were performed using the developer formulation B of the present invention and developer DF-1 as described in U.S. Pat. Nos. 5,264,323 and 5,236,816 to Purol; and developer DF-2 commercially available as GRAFKEM NON TOX RADR from Grafkem Corporation, 2445 W. 147th Street, Posen, Ill., 60469 and as described in U.S. Pat. No. 5,098,819 to Knapp.

All three compositions contain ascorbic acid as a developing agent. However, the DF-1 developer contains potassium carbonate in an amount greater than composition B (greater than 0.5 moles) and does not contain any sulfite component; and the DF-2 composition contains sodium sulfite and potassium carbonate in an amount less than composition B.

As in EXAMPLE I, a pH profile study and accelerated oxidation test were conducted. In addition a 5-day tray oxidation was also conducted. The same four hybrid films (FILMS 1 to 4) used in EXAMPLE I were tested.

The results of the pH profile study are illustrated in FIGS. 6 through 9. The A, B & C plots, respectively for each Figure, represent the GTM, SHLD SPEED and Dmin values for each of the compositions used in processing the films.

A 5-day tray oxidation test was performed to compare the stability of the developers to aerial oxidation in processing rapid access film using FILM 5. The processing conditions were done at room temperature for 90 seconds and 2 minutes. The 5-day tray oxidation test is an open-air test unlike the accelerated oxidation test described earlier. In general, a minimum overall change during the 5 days in shoulder speed, ECI, Dmin and Dmax is desirable. The results for the 90 second processing parameters are illustrated in FIGS. 10A, 10B, 10C and 10D and for the 2 minute processing parameters in FIGS. 11A, 11B, 11C and 11D. The results from this tray test and accelerated oxidation test are expected to be the same.

Figure 12A:
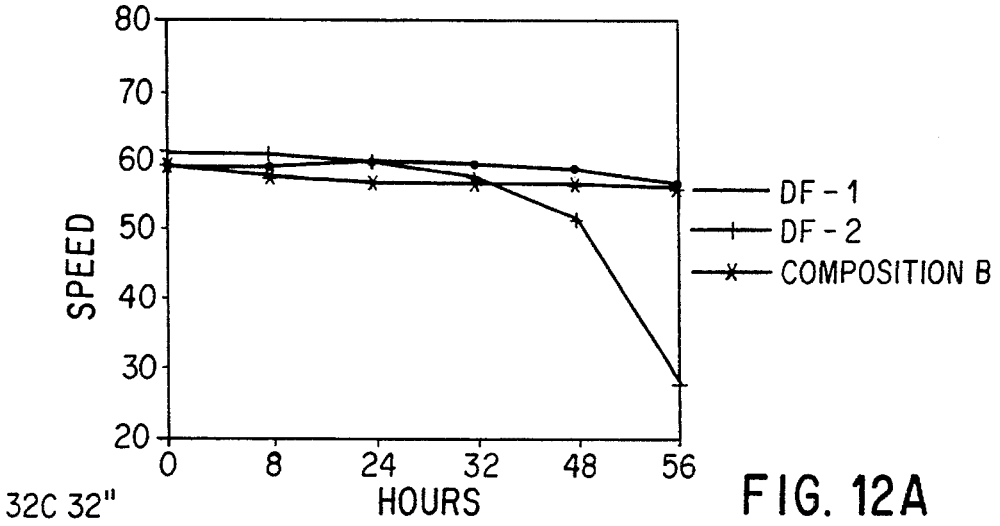
Figure 12B:
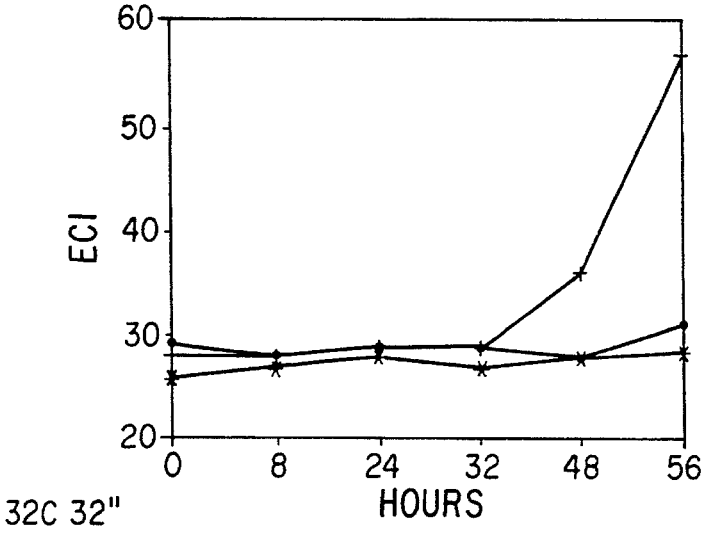
Figure 12C:
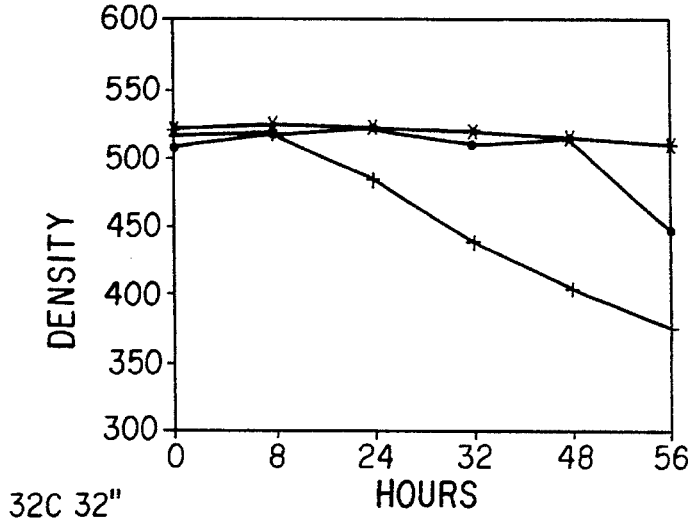
Figure 13A:
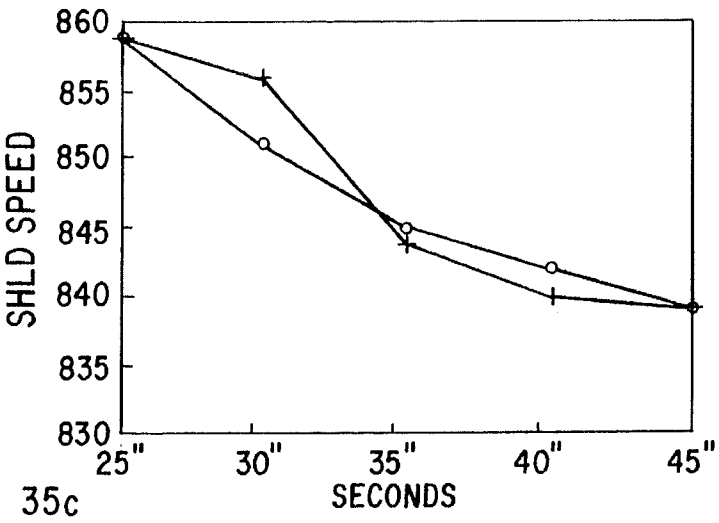
Figure 13C:
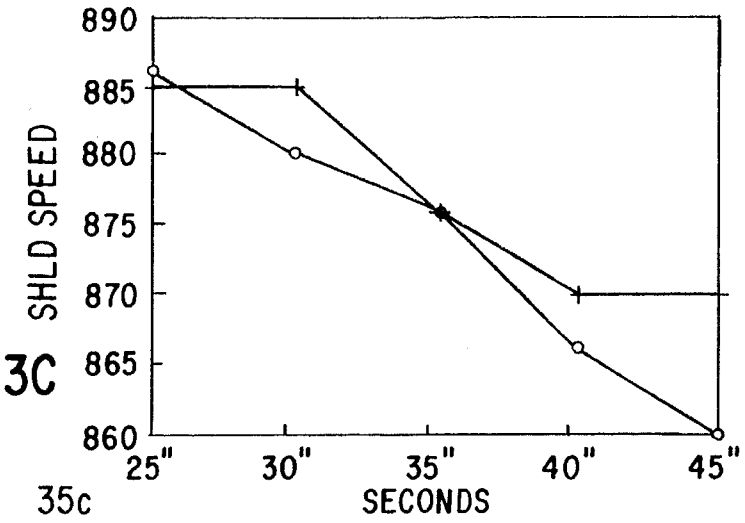
Figure 13B:
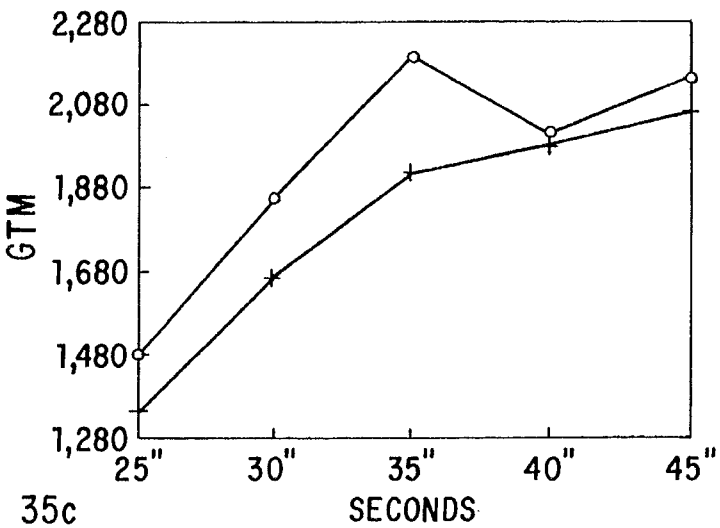
Figure 13D:
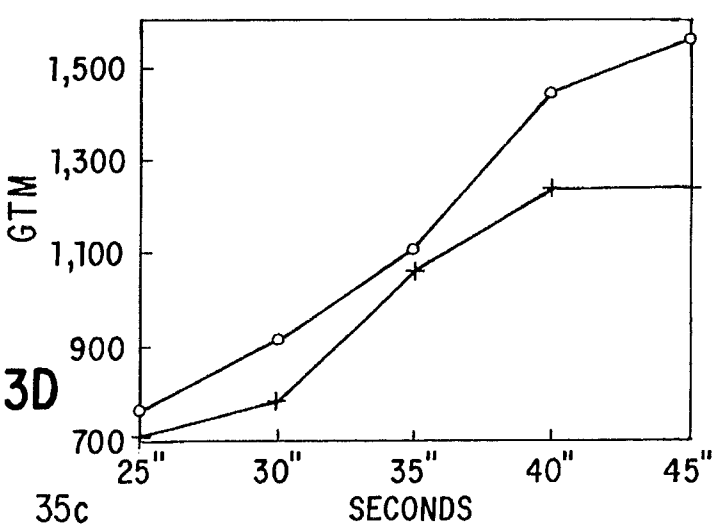
Figures 14A, 14B, 14C, 14D:
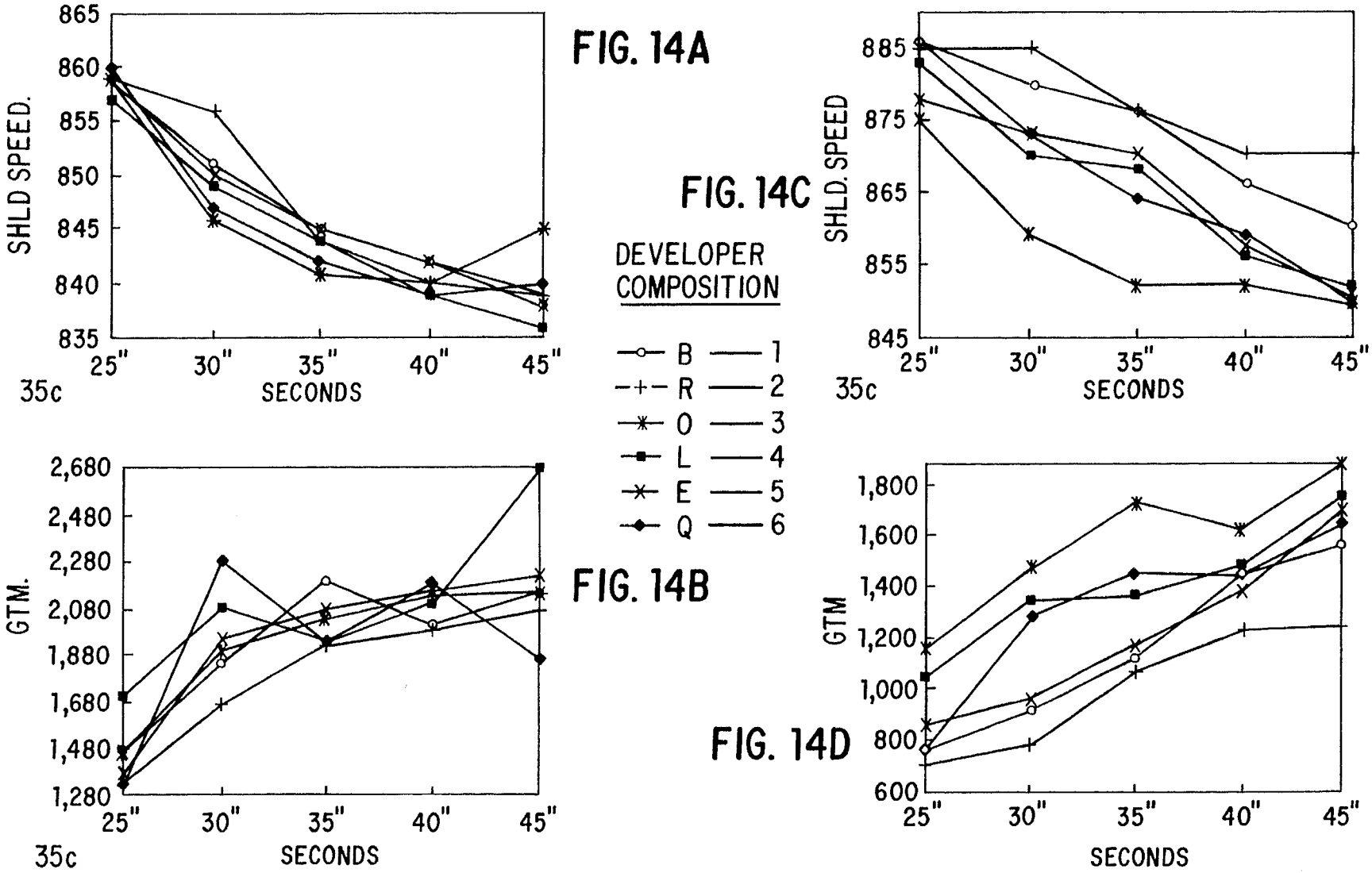

Finally, accelerated oxidation tests were conducted using a Cordell processor as in EXAMPLE I, using the DF-1, DF-2 and formulation B compositions for a period of 56 hours (32° C., 32 seconds), in processing rapid access FILM 5. The shoulder speed, ECI and Dmax density values are illustrated in FIGS. 12A, 12B and 12C, respectively. In general, the smaller the ECI number the better the chemical activity of the developer. It is desirable for developers to maintain a minimum change in the stated process parameters over the 56 hour time period.

In the comparison study, the pH profile results indicate that composition B gave superior response than DF-2. In the 5-day oxidation tests, the three developers all performed relatively well. However, the DF-1 developer began to show an increase in stain or Dmin values, which was not observed in the DF-2 or composition B developers. In addition it was found that composition B remained clear in color whereas DF-1 became discolored. In the accelerated oxidation tests the DF-2 developer performed poorly due to its low capacity. Formulation B compared to DF-1 was found to perform better in this test due to the sulfite component present.

EXAMPLE III

The following experiments establish the advantage of incorporating p-hydroxyphenylmercaptotetrazole (HPMT) into the developing compositions of the invention to provide enhanced performance. Two parameters were measured, shoulder speed (SHLD SPEED-light sensitivity) and gradation (GTM). The rates of development for the following developer compositions were tested using hybrid FILMS 1 and 2 from the previous examples. Developer composition B with HPMT and developer composition B with PMT was compared. The results for each film and respective process parameters are illustrated in FIGS. 13A, 13B, 13C and 13D. As shown in the graphs, the developer with HPMT showed a faster speed and better toe to mid gradation (GTM) over the processing time range studied (25 to 45 seconds) in both FILM 1 and 2.

EXAMPLE IV

In this example, the rates of development of various developer compositions of the invention were tested. As in EXAMPLE III, hybrid FILM 1 and 2 were used and the two parameters, SHLD SPEED and GTM were measured. The results of these tests are illustrated in FIGS. 14A, 14B, 14C and 14D. As shown in the graphic illustrations the following six developer compositions from TABLE I were compared:

Composition 1—formulation B including HPMT

Composition 2—formulation R in which HPMT is replaced with PMT

Composition 3—formulation O including PEO amine and HPMT

Composition 4—formulation L with sequestering agent DAPTA

Composition 5—formulation E with Dimezone S increased to 1.3—g/l

Composition 6—formulation Q without sequestering agent

The hybrid films were processed using a LUTH DEVOTEC 20 processor, manufactured by Development Technologies, Inc., 21405 Airpark Drive, P.O. Box 97, Elkwood, Va., 22718. Processing was done at 35° C. for 25", 30", 35", 40" and 45". This type of test gives an indication of developer activity or strength and can also be used to establish optimum time for the full development of a film at a given temperature.

From the data presented in FIGS. 14 A, B, C and D, all the developing compositions provided effective development of hybrid films with (FILM 1) and without (FILM 2) an incorporated amine in the photographic element.

EXAMPLE V

Unexposed material, hybrid FILMS 1, 2, 3 and 4 used in Example I, is given a contact exposure through a half-tone screen and a continuous wedge. The film is then processed at the standard processing condition of 35° C., 35' and the dots obtained examined and rated. The rating is on a scale of 1 to 5 where 1 is the best and 5 is the worst. A minus sign next to the number means the rating is closer to the lower rating, i.e. a 3—is actually a rating between 3 and 4. The rating was done by viewing the dots at 50 power magnification. The results are listed in the TABLE II below.

TABLE II

| | DOT QUALITY ANALYSIS | | | |
|---|---|---|---|---|
| DEVELOPER COMPOSITION | FILM 1 | FILM 2 | FILM 3 | FILM 4 |
| A | 4 | 1– | 3 | 4 |
| B | 2– | 2– | 3– | 5 |
| C | 4 | 4 | 5 | 5 |
| D | 2 | 2 | 3 | 3– |
| E | 3 | 3 | 4 | 4 |
| F | 3 | 2 | 2– | 4 |
| G | 3 | 3– | 4 | 4– |
| H | 1– | 1 | 2 | 2 |
| I | 3 | 2– | 3 | 5 |
| J | 2– | 2 | 4 | 4 |
| K | 2 | 1– | 2 | 2 |
| L | 3 | 2 | 4 | 5 |
| M | 3 | 2 | 5 | 5 |
| N | 2 | 1– | 3 | 4 |
| O | 4 | 2– | 4 | 4 |
| P | 2 | 3 | 4 | 5 |
| Q | 3 | 2 | 3 | 5 |
| R | 4 | 5 | 5 | 5 |
| S | 3 | 3 | 4 | 4 |

It will be recognized by those skilled in the art that the developing compositions of the invention provide non-toxic developing agents which have environmental advantages over hydroquinone developing agents. The compositions and method of the invention have wide applications in graphic arts and black and white systems. Advantageously, the compositions and method of the invention overcomes the problem of shelf-life stability and capacity problems associated with known ascorbic acid developers.

Further advantage of the developing compositions of the invention are in the provision of a "non-hazardous material" which is not subject to strict regulatory guidelines of the Department of Transportation (DOT) for hazardous materials. Prior to transporting chemicals, by air, sea or land, the DOT requires certain tests be performed and the results are used to classify the product as either hazardous or non-hazardous. The results are further used to determine the type of packaging and mode of transportation for the chemicals. The ascorbic acid developing compositions of the invention, having a pH of less than 11, are classified as non-hazardous materials. The benefits of such a classification are that a wide variety of packaging options are available and the additional possibility of lower freight cost.

Numerous modifications are possible in light of the above disclosure incorporating the use axillary developing agents, sequestering agents, antifoggants, restrainers and/or amine boosters.

Therefore, although the invention has been described with respect to illustrations and examples thereof it is not to be limited to those because it is considered that one skilled in the art will be able to utilize substitutes and equivalents to make such compositions without departing from the scope and spirit of the invention as defined in the claims appended hereto.

We claim:

1. A photographic developing composition, having a pH in the range of from 10,1 to 10.9 that is free of dihydroxybenzene developing agents comprising:

at least 0.17 moles per liter of an ascorbic acid based developing agent;

0.3 to 0.5 moles per liter of a sulfite;

more than 0.25 moles per liter of potassium carbonate buffer;

wherein said carbonate buffer and said ascorbic acid are present in molar amounts such that said carbonate buffer is greater than the amount of said ascorbic acid.

2. The photographic developing composition according to claim 1, wherein said developing agent is selected from the group consisting of ascorbic acid, analogues of ascorbic acid, isomers of ascorbic acid, sugar-type derivatives of ascorbic acid, their salts and mixtures thereof.

3. The photographic developing composition according to claim 1, wherein said developing agent is L-ascorbic acid, D-ascorbic acid, their salts or mixtures thereof.

4. The photographic developing composition according to claim 1, wherein said sulfite is an alkali metal sulfite.

5. The photographic developing composition according to claim 1, further comprising 0.0015 to 0.0063 moles per liter of an auxiliary developing agent selected from the group consisting of pyrazolidone compounds and amino phenols.

6. The photographic developing composition according to claim 1, further comprising a sequestering agent.

7. The photographic developing composition according to claim 6, wherein said sequestering agent is an amino substituted tetra-acetic acid derivative.

8. The photographic developing composition according to claim 1, further comprising an amino booster.

9. The photographic developing composition according to claim 8, wherein said amino booster is n-benzyl, n-methylamino ethoxyethoxyethanol.

10. The photographic developing composition according to claim 1, further comprising benzotriazole.

11. The photographic developing composition according to claim 1, further comprising sodium bromide or potassium bromide.

12. The photographic developing composition according to claim 1, further comprising p-hydroxyphenyl mercaptotetrazole.

13. The photographic developing composition according to claim 1, wherein said composition is for hybrid and rapid access film/paper materials.

14. A photographic developing composition, that is free of hydroquinone developing agents, in the form of a dry powder comprising dry constituents equivalent to:

at least 0.17 molar of an ascorbic acid based developing agent;

0.3 to 0.5 molar of a sulfite selected from the group consisting of sodium sulfite and potassium sulfite; and more than 0.25 molar of a potassium carbonate buffer;

wherein said carbonate buffer and said ascorbic acid are present in molar amounts such that said carbonate buffer is greater than the amount of said ascorbic acid.

15. The photographic developing composition according to claim 14, wherein water is added to said dry constituents to form a composition with a pH in the range of from 10.1 to 10.9.

* * * * *